US006427860B1

(12) United States Patent
Nishida et al.

(10) Patent No.: US 6,427,860 B1
(45) Date of Patent: Aug. 6, 2002

(54) EASY-OPEN CAN LID SUPERIOR IN CAN OPENABILITY AND PROCESS FOR PRODUCTION THEREOF

(75) Inventors: Hiroshi Nishida; Hidekuni Murakami; Masayoshi Suehiro; Shoji Nosaka, all of Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/509,586

(22) PCT Filed: Sep. 30, 1998

(86) PCT No.: PCT/JP98/04418

§ 371 (c)(1),
(2), (4) Date: Mar. 29, 2000

(87) PCT Pub. No.: WO99/16676

PCT Pub. Date: Apr. 8, 1999

(30) Foreign Application Priority Data

Sep. 30, 1997 (JP) ..... 9-267517

(51) Int. Cl.[7] ..... B65D 17/34; B21D 51/44
(52) U.S. Cl. ..... 220/269; 413/16; 413/9
(58) Field of Search ..... 220/268, 269, 220/270, 276, 906; 413/9, 15–18, 58, 62, 63, 67

(56) References Cited

U.S. PATENT DOCUMENTS 5,219,257 A * 6/1993 Koch ..... 413/67

FOREIGN PATENT DOCUMENTS

| | | |
|---|---|---|
| EP | 0542104 | 5/1993 |
| FR | 0737624 | 10/1996 |
| JP | 48-40553 | 12/1973 |
| JP | 49-52081 | 5/1974 |
| JP | 49-104787 | 10/1974 |
| JP | 51-8081 | 1/1976 |
| JP | 51-14949 | 5/1976 |
| JP | 52-12089 | 1/1977 |
| JP | 62-64441 | 3/1987 |
| JP | 5-65162 | 3/1993 |
| JP | 5-162761 | 6/1993 |
| JP | 6-115548 | 4/1994 |
| JP | 6-190965 | 7/1994 |
| JP | 8-224626 | 9/1996 |
| JP | 9-108756 | 4/1997 |
| JP | 9-201634 | 8/1997 |

* cited by examiner

*Primary Examiner*—Nathan J. Newhouse
(74) *Attorney, Agent, or Firm*—Kenyon & Kenyon

(57) ABSTRACT

A can lid made of a metal sheet having a resin coating on at least one surface thereof and superior in can openability, having an outer peripheral flat portion and an inner peripheral flat portion straddling a score line further having an outer bead and inner bead at the sides of the outer peripheral flat portion and the inner peripheral flat portion opposite to the score line, and having a cross-section where the score line becomes gradually thinner from the thicknesses of the outer peripheral flat portion and the inner peripheral flat portion and a process for forming the same.

14 Claims, 12 Drawing Sheets

(A)

(B)

EASY-OPEN CAN LID SUPERIOR IN CAN OPENABILITY AND PROCESS FOR PRODUCTION THEREOF

TECHNICAL FIELD

The present invention relates to a metal container can lid, more particularly to a metal easy-open can lid which enables part or substantially all of the can lid to be easily opened manually and to a process for producing the same. This can lid is used for beverage cans or general food cans and a wide range of other applications.

BACKGROUND ART

The easy-open can lids (or easy-open can lids) used for beverage cans, general food cans, etc. are made of surface-treated aluminum sheet or steel sheet provided with score lines (or guide lines for opening) for tearing of the can lid to form an opening for removing the contents of the can.

At present, the method for forming a score line, as shown in FIG. 1, is to shape the can lid material 1 into the basic form of the can lid, then placed it on a flat die 2 and press down a die 3 having a projection of the shape of the contour of the opening to form a guide groove for opening (score) 4 of the shape of the opening in the material. To facilitate the can openability, it is necessary to press the die down until the score depth reaches about ½ to ⅔ of the thickness of the sheet before processing. However, if the depth of the score is too shallow, the can openability becomes poor, while if too deep, the strength becomes insufficient and the problem arises of the can opening in transport by a small impact from the outside. Therefore, there have been the problem that the projection of the die for forming the score is required to have a high precision in the shape of the angular tip of the projection and the shape of the projection of the die changes and deteriorates due to wear when forming the score.

On the other hand, as shown in FIG. 2, as in Japanese Unexamined Patent Publication (Kokai) No. 6-115548, Japanese Unexamined Patent Publication (Kokai) No. 8-224626, and Japanese Unexamined Patent Publication (Kokai) No. 9-108756, the process of production of an easy-open can lid by pressing the can lid material 1 by the shoulder portions of punch shoulder 8 and die shoulder 9 of upper and lower dies of an upper die (i.e., punch) 5 and lower die (i.e., die) 6 to form the score line has been proposed. However, according to this method, since the contour of the score line is generally asymmetric, the deformation of the material at the time of pressing did not become uniform and it was difficult to obtain a desired distribution of thickness across the entire length of the score line. That is, if trying to control the thickness of the thinnest portion of the score line (residual thickness) to be thin so as to improve the can openability, partially broken or extremely thin portions will be formed resulting in leakage of the contents and occurrence of unnecessary opening due to impact at the time of transport etc. Further, if trying to control the residual thickness to be thick in order to avoid breakage or occurrence of extremely thin portions, the problem will remain that part of the score line will not tear even after an opening operation, and therefore, the can openability will be insufficient.

DISCLOSURE OF THE INVENTION

For the formation of the score of commercialized easy-open can lids, a scoring blade having an acute cross-section is used. Further, even in the push-tab type, the tear strip is cut using a sharp cutting blade. There are problems in these in terms of productivity from the viewpoint of the tool life. Further, particularly when using steel sheet as a material, the surface coating is broken by the processing and the metal is exposed, so repair coating is required. Further, when it comes to recycling, even among metal cans, while so-called "monometal cans" where the can body and the can lid are formed by the same material can be said to be suitable for recycling, the present easy-open can lids are almost all made of aluminum. On the other hand, the bodies and can lids other than easy-open can lids are almost all made of steel sheet. Therefore, there has been a fervent desire for the development of some means enabling production, with a good productivity, of easy-open can lids made of steel sheet which are superior in can openability and superior in corrosion resistance.

An easy-open can lid in which a score line is formed by pressing the above resin laminated metal sheet by the shoulder radii of upper and lower dies is meant to solve the above-mentioned problem, but practical problems remain in regard to the can openability and corrosion resistance.

As explained above, even with the method of pressing the shape of an opening by the shoulders of the upper and lower dies proposed for solving the change and deterioration of the shape of the projection of the die due to wear at the time of scoring, there are still problems remaining in the score line formed in the easy-open can lid due to the processing precision such as how to simultaneously achieve can openability, air-tightness, and impact resistance. The present invention achieves higher precision of control of the residual thickness at the time of forming the score line by pressing by die shoulders.

In accordance with the present invention, there is provided a metal easy-open can lid superior in can openability having a resin coating on at least one surface thereof, wherein said easy-open can lid has an outer peripheral flat portion and an inner peripheral flat portion straddling a score line further having an outer bead and inner bead at the sides of the outer peripheral flat portion and the inner peripheral flat portion opposite to the score line, and having a cross-section where the score line becomes gradually thinner from the thicknesses of the outer peripheral flat portion and the inner peripheral flat portion.

The easy-open can lid superior in can openability can have a cross-sectional shape where the gradually thinned thinly formed portion is bent.

In accordance with the present invention, there is further provided an easy-open can lid superior in can openability wherein at least the inner bead is shaped projecting to the can outside, the deepest recess point toward the can inside of the inner peripheral flat portion is positioned toward the can inside in a range of 0.2 to 4.0 mm at the can outside surface compared with the highest projecting point toward the can outside of the inner bead, the interface portion of the outer peripheral flat portion and the score line is positioned toward the can outside in a range of 0.1 to 2.0 mm at the can outside surface compared with the deepest recess point toward the can inside of the inner peripheral flat portion, and the widths of the inner peripheral flat portion cross-section and the outer peripheral flat portion cross-section are respectively from 0.1 to 3.0 mm.

The easy-open can lid can be made of a metal sheet such as steel sheet, surface-treated steel sheet, aluminum sheet, or aluminum alloy sheet. The resin coating on the surface of the metal sheet at least at the can inner surface side can be made by a thermoplastic saturated polyester-based resin of a thickness of 10 to 100 μm. Further, the resin coating corresponding to the can outer surface can be made with a polyamide resin having a thickness of 10 to 100 μm.

The easy-open can lid according to the present invention, is either of the types where can lid does has not a tab for opening a tear strip provided at least at one location of the can lid separating part or all of the can lid from the can body and the can lid does has not a tab for opening a tear strip provided at least at one location of the can lid leaving part or all of the can lid on the can body.

Further, the easy-open can lid may be opened by the method of opening a tear strip provided at least at one location of the can lid, without a tab, leaving part of the tear strip at the can body or separating it from the can body.

In accordance with the present invention, there is provided a method of forming an easy-open can lid superior in can openability comprising, when pressing the shape of the opening by shoulders of upper and lower dies, pressing by using an upper die (punch) and lower die (die) provided with recesses at the die centers for restraining the shaping material at the lower die and/or upper die, having at least one of the punch shoulder R and die shoulder R of not more than 2.0 mm, and having the punch and die overlap on a parallel line of operation of the punch.

In the above method of formation, preferably the depth of the recess of the lower die (die) is not more than (punch shoulder R+die shoulder R)×4 and the depth of the recess of the upper die (punch) head is at least 0.2 mm.

In accordance with the present invention, there is further provided a method of forming an easy-open can lid superior in can openability comprising, when pressing the shape of the opening by shoulders of upper and lower dies, pressing by using upper and lower dies provided with recesses at the die centers for restraining the shaping material at the lower die and/or upper die, having a shape of the shoulders of the die and the punch of part of an ellipse having a long radius of 0.1 to 5.0 mm and a short radius of 0.05 to 4.0 mm, and having the punch and die overlap on a parallel line of operation of the punch.

In the above method of formation, preferably the depth of the recess of the lower die (die) is not more than (punch shoulder R+die shoulder R)×4 and the depth of the recess of the upper die (punch) head is at least 0.2 mm.

BRIEF DESCRIPTION OF THE DRAWINGS

The present invention will be explained in further detail below with reference to the drawings.

BEST MODE FOR CARRYING OUT THE INVENTION

The present invention will now be described in further detail.

Figure 1:
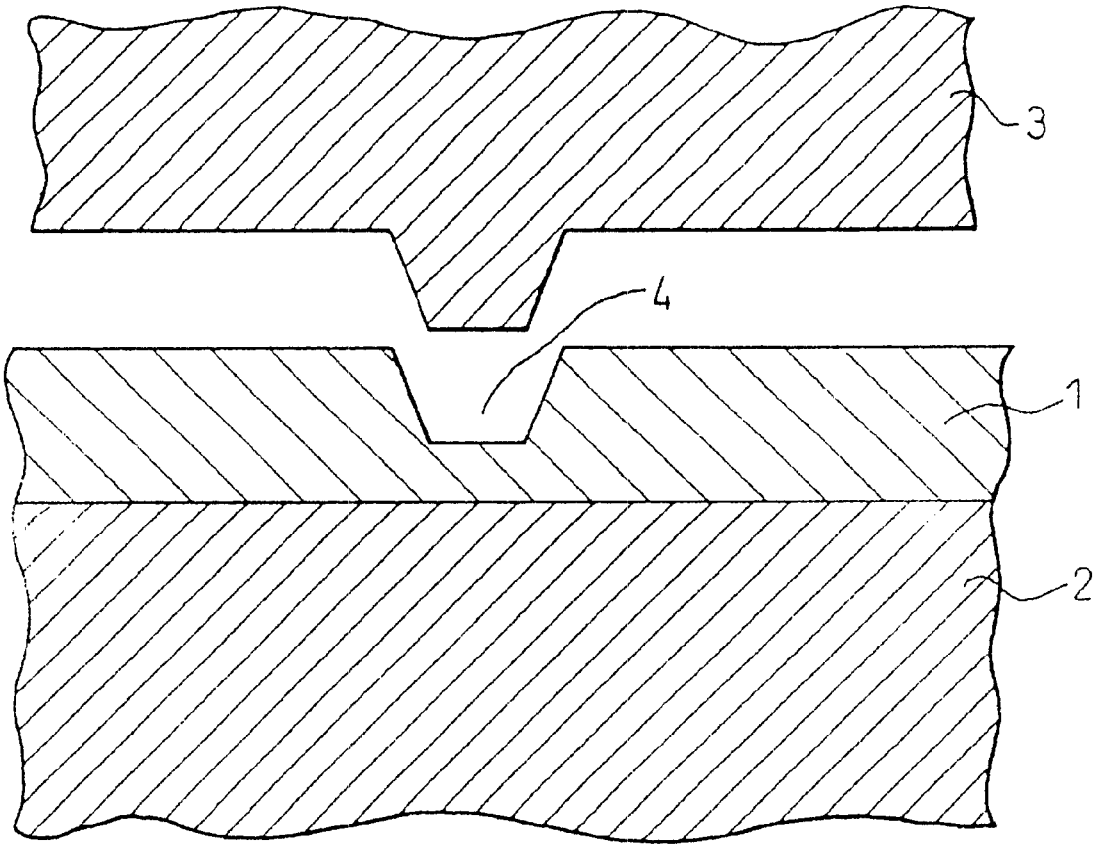
Fig.1 PRIOR ART
FIG. 1 is a view of the process of production of an can lid using a flat die of the related art and a score having a V-shaped cross-section.
Figure 2:
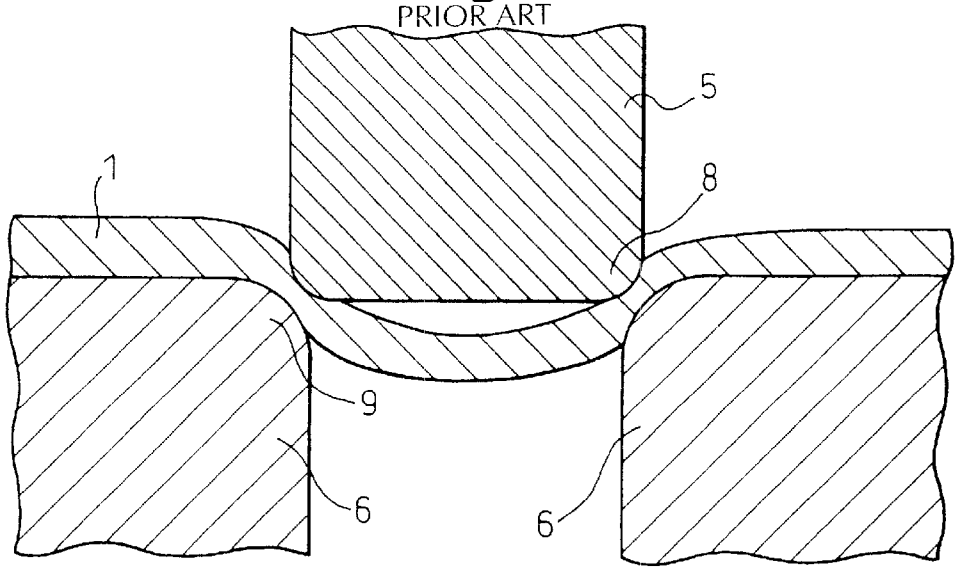
Fig.2 PRIOR ART
FIG. 2 is a view of the method of pressing the shape of an opening by the shoulders of upper and lower dies of the related art.
Figure 3:
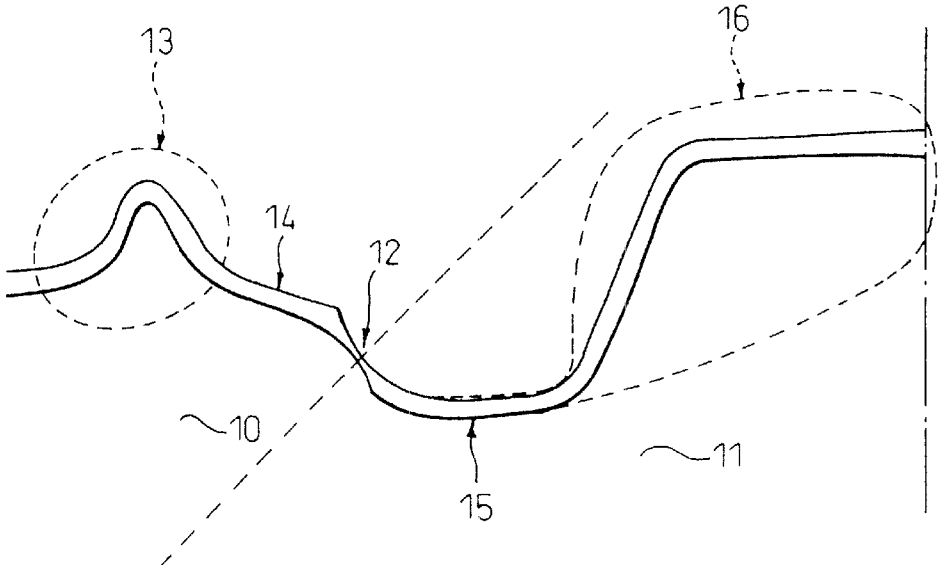
FIG. 3 is a sectional view of the area near the score line of the present invention.

First, a first aspect of the present invention will be explained. The present invention, as shown in FIG. 3, provides an easy-open can lid made of a metal sheet free from repair of the inner and outer surfaces and provided with both corrosion resistance and can openability by making the sectional shape of the area near the score line 12 one having an outer peripheral flat portion and inner peripheral flat portion between an outer bead 13 and inner bead 16 and having a score line 12 of a shape which becomes gradually thinner between the outer peripheral flat portion 14 and the inner peripheral flat portion 15.

The sectional shape is not necessarily required along the entire length of the score line 12. It is sufficient if at least 30% of the score line 12 has that shape. Further, depending on the relationship with the position of the opening, the countersink or clinched portion may be used instead of the outer bead.

The flat portions 14 and 15 spoken of here mean flat portions including portions of a radius of curvature of at least 50 mm. Further, the length of the flat portions is called the length of the width of the portion having a radius of curvature of at least 50 mm.

In forming the score line 12, since the resin coating is broken by pressing by a sharp blade according to the related art, repair coating is required, and therefore, the present invention has a gradually thinned score line 12. Becoming gradually thinner means the sheet thickness has a rate of change of not more than 1000 μm/mm at small portions where the thickness changes. More preferably a range of 250 to 750 μm/mm is preferable.

This is because when forming a score line 12 of a rate of change of more than 1000 μm/mm, defects occur in the resin coating and poorly bonded portions of the coating occur.

To ensure a stable, sound coating, not more than 750 μm/mm is preferable. Further, if less than 250 μm/mm, the processed portion reduced in thickness becomes too long, and therefore, the portion reduced in bonding with the coating becomes broader. If the reduction in thickness becomes too gradual, stress tends to concentrate at the time of opening and there are concerns about the can openability. Therefore, a range of 250 to 750 $\mu$m/mm is preferable. Such a gradually thinned score line 12 can be formed by pressing by the shoulders of upper and lower dies.

As proposed in Japanese Unexamined Patent Publication (Kokai) No. 6-122438, in the case of an easy-open can lid obtained by thinning a metal sheet by pressing by the shoulder radii of upper and lower dies and then further pushing back the sheet to form a V-shaped bent portion to make the score, the can openability is improved. When the thinned portion is formed into a V-shape by pushing back, the bonding of the resin coating at that portion easily falls, and therefore, the problem remains that careful care is required to prevent corrosion or rusting.

Therefore, the present invention only processes the area near the gradually thinned score line 12 to make it gradually thinner and forms the score line 12 between the outer peripheral flat portion 14 remaining as the can lid and the inner peripheral flat portion 15 forming the opening portion so as to ensure the bonding of the resin coating in the area of the score line 12. Further, beads 13 and 16 are provided at the outside of the outer peripheral flat portion 14 and the inside of the inner peripheral flat portion 15. Due to this, stress easily concentrates at the score line 12 when giving stress for opening the can. In pressing by a sharp blade of the related art, a V-shaped groove is formed and the can is opened by a shear force. In the case of the gradually thinned score line 12, the can is opened by tensile breakage of the metal sheet. This is because by giving the two beads 13 and 16, it is possible to effectively utilize the stress for opening the can for tensile breakage of the sheet along the score line 12.

In particular, in the case of a stay-on type easy-open can lid, part of the opening is broken (initially broken) by pulling the tab and then the tab is further pulled to fully open the can. However, the initial breakage is difficult. If the stroke of the tab is used up for the initial breakage, there is no longer any tab stroke for opening the can and there is the problem that the can is only half opened.

As shown in the present invention, when initial breakage occurs due to pulling, if the area near the score line 12 is V-shaped or S-shaped, the tab stroke is sometimes used up for the deformation of the V-shape or S-shape.

The present invention makes effective use of the tab stroke by positioning the score line 12 between the inside and outer beads and gradually thinning the area near the score line 12.

Figure 4:
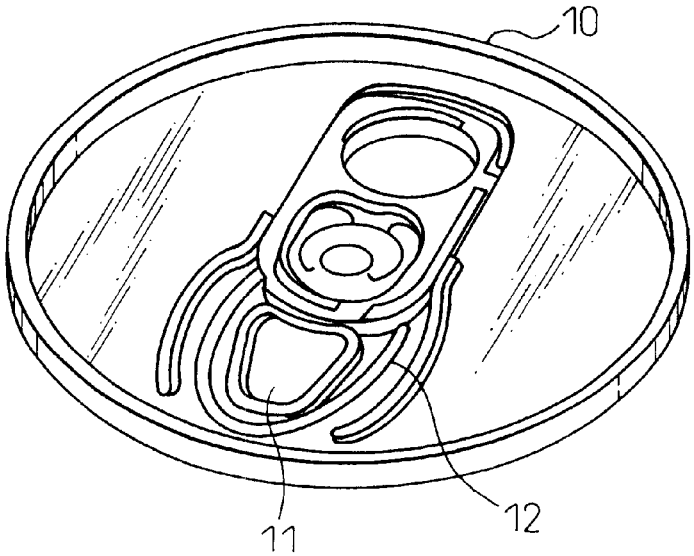
FIG. 4 is a view of an example of an easy-open can lid of the present invention.

In particular, in the case of the easy-open can lid 10 of the stay-on type shown in FIG. 4, the inner bead and outer bead are shaped projecting to the can outer surface side, the inner peripheral flat portion has a width of the recessed flat portion (wi=) at the can inner surface side of 0.1 to 3.0 mm in a range of hi=0.2 to 4.0 mm compared with the inner bead and the outer peripheral flat portion has a width of the flat portion (wo=) of 0.1 to 3.0 mm in the range of 0.1 to 2.0 mm from the inner peripheral flat portion (ho=).

If wi and wo are less than 0.1 mm, the bonding of the coating at the score line portion falls and a problem results in terms of the corrosion resistance. Further, if more than 3.0 mm, the distance between the bead and the score line becomes too great and a problem arises in the can openability. Due to this, wi and wo preferably are in a range of 0.1 to 3.0 mm.

If hi is less than 0.2, the rigidity of the tear strip becomes smaller and there is a tendency for the pushdown force of the tab not to be effectively utilized. If ho is less than 0.1 mm, the vector of the force required for causing the initial breakage undesirably becomes off-centered.

If ho is more than 2.0 mm, when transporting the easy-open can lids stacked on each other, flaws are caused due to the upper and lower can lids rubbing against each other. Further, even if hi is more than 4.0 mm, there is the same type of problem in transport.

Figure 5:
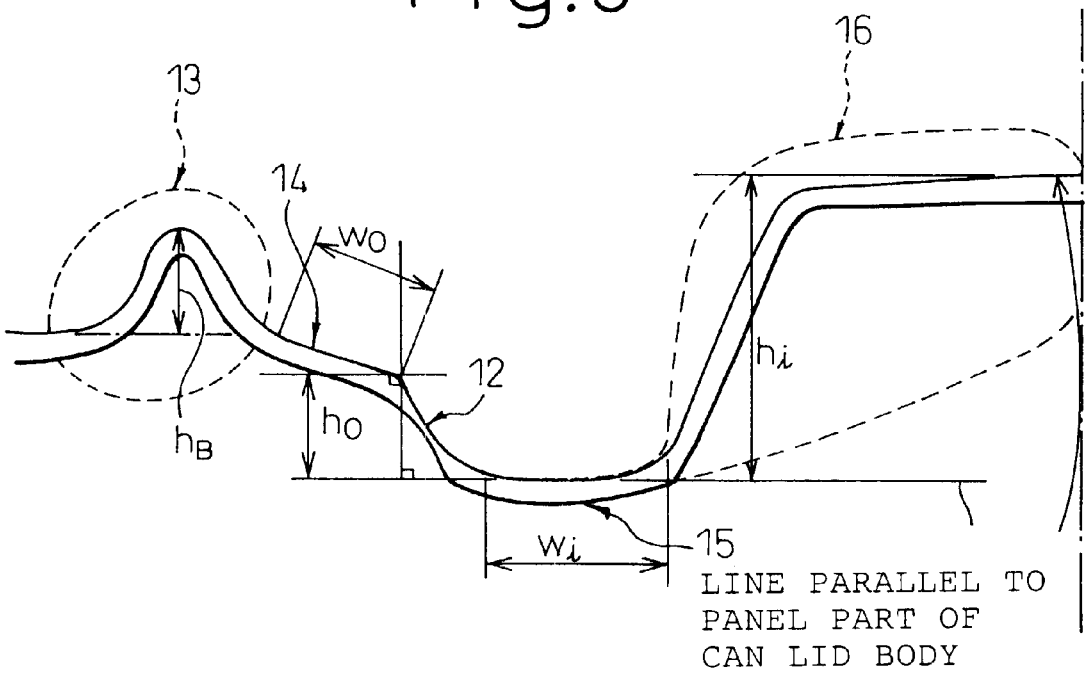
FIG. 5 is a sectional view of the area near the score line of a first aspect of the present invention.

Using the panel portion of the lid body as the horizontal standard, the height and length are calculated by the method shown in FIG. 5. The outer bead may be a projection facing the can inside direction. Note that the height or depth of the outer bead is preferably in the range of ($h_B$=) 0.2 to 3.0 mm. Of course, the above shape an be used for other types of easy-open can lids such as pull-tab types, full-open types, and pushdown types.

If $h_B$ is less than 0.2 mm, the rigidity of the can lid body side becomes smaller and there is an undesirable tendency for the pushdown force of the tab at the time of can opening not being effectively used. Further, if $h_B$ is more than 3.0 mm, when transporting the easy-open can lids stacked on each other, flaws are caused due to the upper and lower can lids rubbing against each other.

The steel sheet is usually one having a thickness $t_0$ of 0.080 to 0.280 mm and having mechanical properties of a hardness ($H_{R30T}$) of 46 to 68 and an elongation of 10 to 60% or so.

The surface of the steel sheet is preferably plated by one or more of Sn, Cr, Ni, Al, and Zn. Chromium-treated steel sheet is preferable.

As the sheet steel specifically used, there are a tin-plated sheet steel giving tin-plating of 0.5 to 3.0 g/m$^2$ and then chemical treatment, a nickel-plated steel sheet giving a nickel plating of 0.3 to 2.0 g/m$^2$ and then chemical treatment, an Sn/Ni-plated sheet steel giving a Ni and then Sn plating of 0.5 to 2.0 g/m$^2$ and 0.01 to 0.5 g/m$^2$, respectively, then chemical treatment, and a chrome-chromate treated sheet steel normally called TFS (Tin Free Steel) giving a metal Cr deposition of 50 to 200 mg/m$^2$ and a chrome oxide deposition of 5 to 30 mg/m$^2$, in terms of chrome.

Further, the aluminum sheet used in the present invention ordinarily has a thickness $t_0$ of 0.18 to 0.32 mm. As the alloy, 5052, 5082, 5182, 5352, 5349, and 5017 and a temper of H19 are preferable.

A surface-treated metal sheet comprising this aluminum sheet treated by chromate, treated by zirconate, or chemically treated by a phosphate-chromate system may also be used. A resin coating is necessary on both surfaces of the metal sheet to ensure the corrosion resistance and rust resistance. The laminated resin at least at the can inner surface side is preferably a saturated polyester-based resin coating of a thickness of 10 to 100 $\mu$m from the viewpoints of economy, corrosion resistance, and flavor.

The saturated polyester-based resin in the present invention means a linear thermoplastic polyester obtained by condensation polymerization of a dicarboxylic acid and diol and is best represented by polyethylene terephthalate. As the dicarboxylic acid component, there are terephthalic acid, isophthalic acid, phthalic acid, adipic acid, sebacic acid, azelaic acid, 2,6-naphthalene dicarboxylic acid, decane dicarboxylic acid, dodecane dicarboxylic acid, cyclohexane dicarboxylic acid, and the like alone or in mixtures. As the diol component, there are ethylene glycol, butane diol, decane diol, hexane diol, cyclohexane diol, neopentyl glycol, and the like alone or in mixtures. Copolymers of two or more dicarboxylic acid components or diol components or copolymers with diethylene glycol, triethylene glycol, and other monomers or polymers are also possible.

Further, when clinching the easy-open can lid on the can body, the resin coating is shaved off and problems arise in workability and appearance in some cases. From the viewpoint of the clinchability, the resin coating of the outer surface is preferably a polyamide resin. As the polyamide resin, there are nylon 6, nylon 12, nylon 5, nylon 11, and the like alone or in mixtures.

Further, the metal sheet resin coating used in the present invention may in accordance with need have blended into it a plasticizer, antioxidant, thermal stabilizer, inorganic particles, pigments, organic lubricants, and other additives.

The thickness of the resin coating at the unprocessed part of the metal sheet used in the present invention is preferably 10 to 100 $\mu$m.

The present invention has a score line comprised of a gradually thinned part of the metal sheet by processing such as pressing by upper and lower dies. Since the resin coating is thinned together with the metal sheet, if the thickness of the resin is less than 10 $\mu$m, the barrier property (corrosion resistance and rust resistance) of the resin coating at the processed part cannot be secured. If more than 100 $\mu$m, the effect on the barrier property of the resin coating becomes saturated and economic disadvantages are incurred. When considering the stability of the performance, economy, etc., a thickness of a range of 16 to 60 $\mu$m is particularly effective.

The thickness of the metal sheet at the portion of the score line is preferably 10 to 75 $\mu$m in the case of steel sheet and 35 to 130 $\mu$m in the case of aluminum sheet in view of securing can openability and securing dropping strength, that is, if the thickness of the metal sheet is thick, the can openability falls, while if it is thin, the dropping strength falls. More preferably, a range of 20 to 60 $\mu$m is preferable in the case of steel sheet and a range of 35 to 125 $\mu$m in the case of aluminum sheet.

In this series of processing steps, the resin coating having the above characteristics is drawn uniformly together with the base material. Further, according to the process of the present invention, the processing is based on extrusion or pushback by the smoothly curved shoulder portions of the projections, so there is almost none of the problem of tool life seen in the method of pressing by a sharp blade. A superior productivity is guaranteed and an easy-open can lid is obtained.

A second aspect of the present invention will be explained in detail below.

Figure 6:
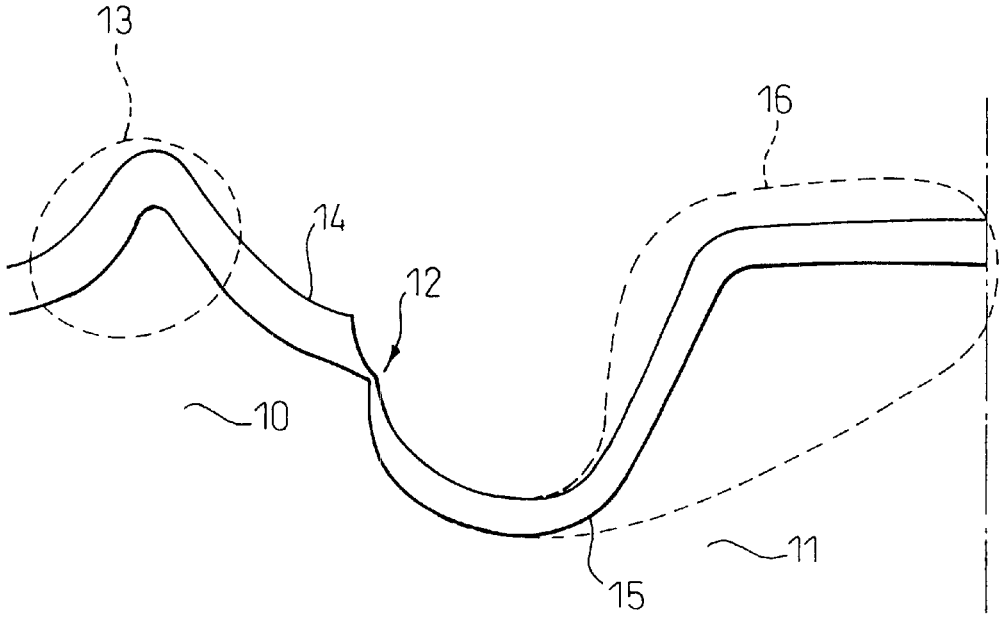
FIGS. 6(A) and 6(B) are sectional views of the area near the score line of a second aspect of the present invention.
Figure 6:
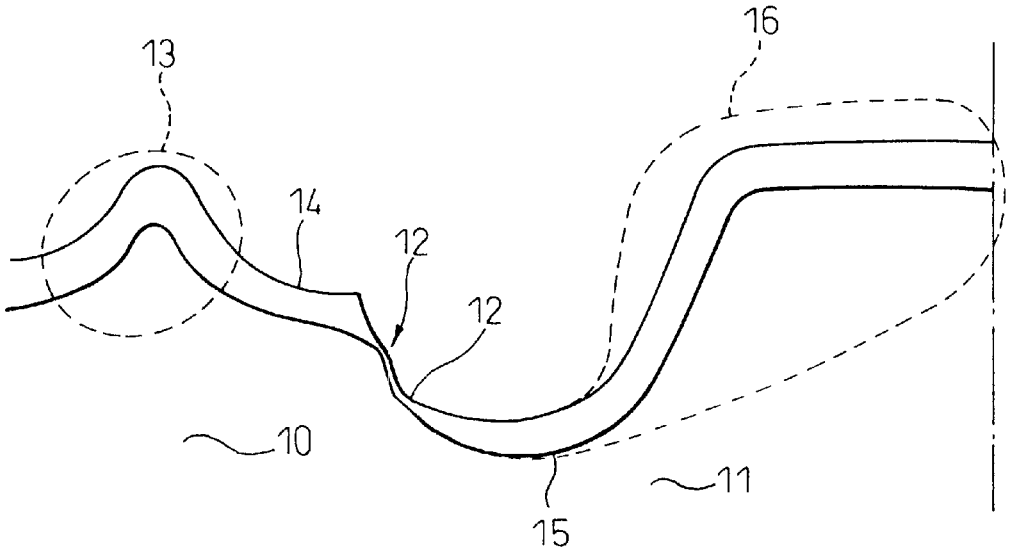

First, the shape will be explained. The present invention, as shown in FIG. 6(A) and FIG. 6(B), provides an easy-open can lid made of a metal sheet and free from repair of the inner and outer surfaces given both can openability and corrosion resistance by making the cross-sectional shape near the score line (bent portion) 12 one having an outer peripheral flat portion 14 and an inner peripheral flat portion 15 between the outer bead 13 and inner bead 16, further having a score line 12 of a shape which becomes gradually thinner between the outer peripheral flat portion 14 and the inner peripheral flat portion 15, and bent. This cross-sectional shape does not necessarily have to extend over the entire length of the score line 12. It is sufficient if at least 30% of the score line 12 has this shape. Further, depending the relationship with the position of the opening, the countersink or clinched portion may be used instead of the outer bead 13.

The flat portions 14 and 15 spoken of here mean flat portions including portions of a radius of curvature of at least 50 mm. Further, the length of the flat portions is called the length of the width of the portion having a radius of curvature of at least 50 mm.

In forming the score line (bent portion) 12, since the resin coating is broken by pressing by a sharp blade according to the related art, repair coating is required, so the present invention has a gradually thinned score line 12. Becoming gradually thinner means the sheet thickness has a rate of change of not more than 1000 $\mu$m/mm at small portions where the thickness changes. More preferably a range of 250 to 750 $\mu$m/mm is preferable.

This is because when forming a score line 12 of a rate of change of over 1000 $\mu$m/mm, defects occur in the resin coating and poorly bonded portions of the coating occur.

To ensure a stable, sound coating, not more than 750 $\mu$m/mm is preferable. Further, if less than 250 $\mu$m/mm, the processed portion reduced in thickness becomes too long, so the portion reduced in bonding with the coating becomes broader. If the reduction in thickness becomes too gradual, stress tends to concentrate at the time of can opening and there are concerns about the can openability. Therefore, a range of 250 to 750 $\mu$m/mm is preferable. Such a gradually thinned score line can be formed by pressing by the shoulders of upper and lower dies.

In the case of an easy-open can lid having a score of a V-shaped groove formed by pressing by a sharp blade of the related art, the can is opened by a shear force. However, in the case of the gradually thinned score line as in the present invention, the can is opened by tensile breakage of the metal sheet. Giving the two beads enables the stress due to the can opening to be effectively utilized for the tensile breakage of the score line and improves the can openability. Further, due to the cross-sectional shape where the portion formed thinly in thickness is bent, the stress for opening the can easily concentrates due to the bent shape and enables the can openability to be further improved. The angle of the bend is more preferably from 20 degree to 90 degree. If more than 90 degree, the bonding of the resin coating falls in the thinning process. The bending further causes the bonding of the resin coating to fall and makes it necessary to take careful care so that corrosion or rust does not occur. Further, if less than 20 degree, the extent of improvement of the can openability becomes smaller.

Figure 7:
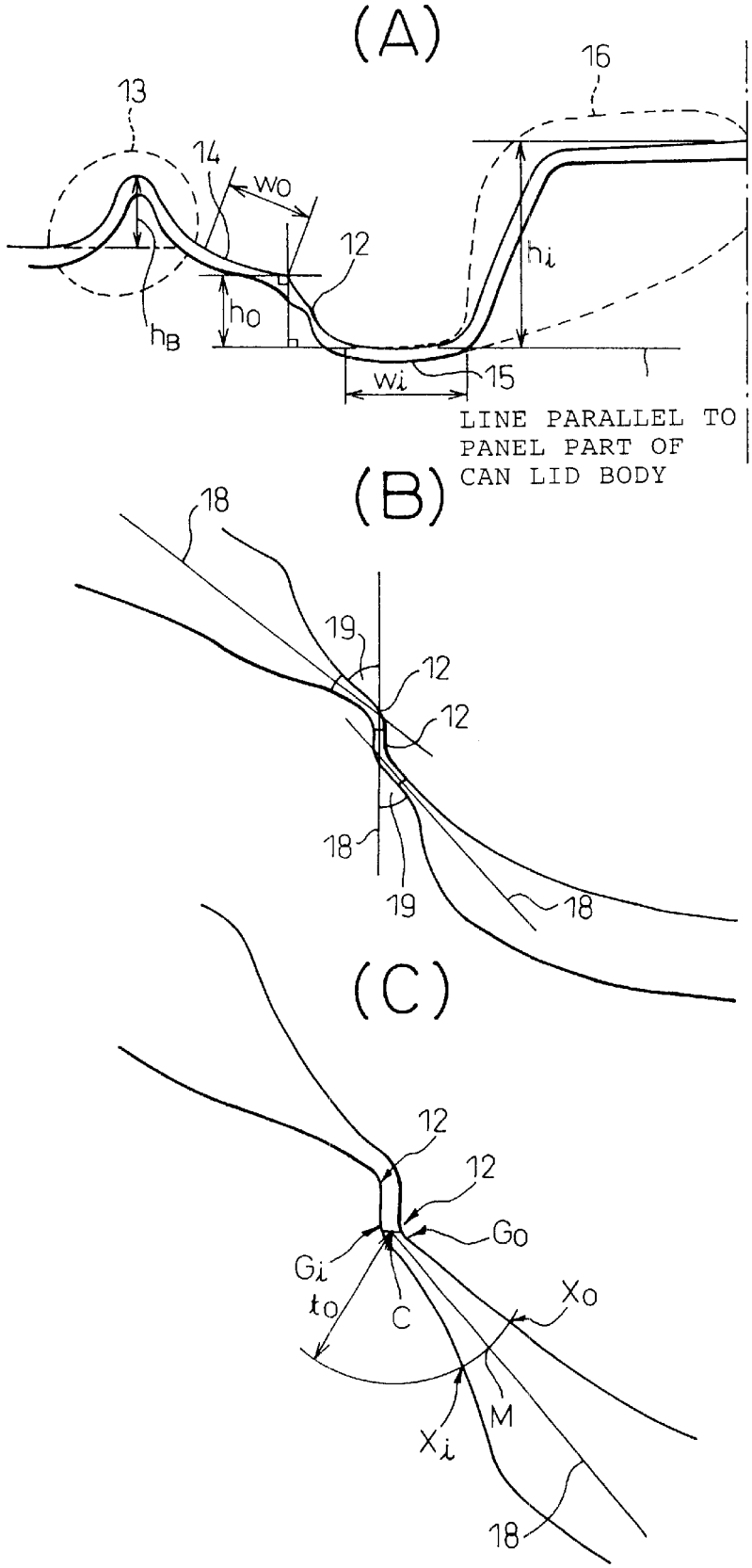
FIGS. 7(A), 7(B), and 7(C) are sectional views of the area near the score line of the second aspect of the present invention and the bent part of the thinly formed portion.

Note that the angle 19 of the bent portion may be found as the angle of the intersection with the center line 18 of the base material at the two sides of the bent portion as shown in FIG. 7(B). Next, an explanation will be made of an example of the method of drawing the center line by FIG. 7(C). First, the peak of the curved portion 12 is determined. The portion of the smallest radius of curvature of the surface of the metal sheet at the can inner surface side of the bent portion 12 is made Gi, the portion of the smallest radius of curvature of the surface of the metal sheet at the can outer surface side is made Go, and the center point of the line segment Gi-Go is made the peak C. An arc of a distance of the thickness $t_0$ of the metal sheet before processing from the peak C is drawn, the intersection with the surface of the metal sheet at the can inner surface side is made Xi, and the intersection with the surface of the metal surface of the can outer surface side is made Xo. The line passing through the peak C and the center point M of the line segment Xi-Xo is made the center line 18. Note that as the center line between peaks in the case where there are a plurality of peaks, the line connecting the peaks is made the center line. Further, as shown in FIG. 6(B) and FIG. 7(B), there is no problem even if a plurality of bent portions are formed at the portion of the sheet formed thinner.

Figure 8:
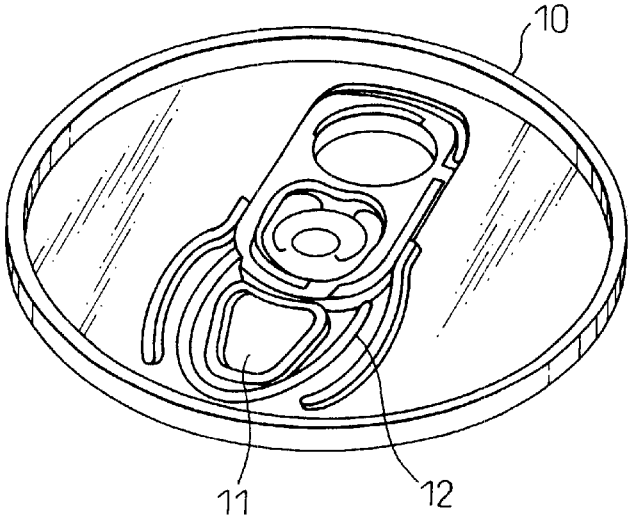
FIG. 8 is a view of an example of an easy-open can lid of the second aspect of the present invention.

In particular, in the case of an easy-open can lid 10 of the stay-on type shown in FIG. 8, as shown in FIG. 7(A), the inner bead 16 and the outer bead 13 are shaped projecting to the can outer surface side. The inner peripheral flat portion 15 has a width of the recessed flat portion (wi) at the can inner surface side of 0.1 to 3.0 mm in the range of hi=0.2 to 4.0 mm compared with the inner bead 16, while the outer peripheral flat portion 14 has a width of the flat portion (wo) of 0.1 to 3.0 mm in the range of 0.1 to 2.0 mm from the inner peripheral flat portion 15 (ho). If wi and wo are less than 0.1 mm, the bonding of the coating at the score line 12 portion falls and a problem results in terms of the corrosion resistance. Further, if more than 3.0 mm, the distance between the bead and the score line 12 becomes too great and a problem arises in the can openability. Due to this, wi and wo preferably are in a range of 0.1 to 3.0 mm.

If hi is less than 0.2 mm, the rigidity of the tear strip becomes smaller and there is a tendency for the pushdown force of the tab not to be effectively utilized. If ho is less than 0.1 mm, the vector of the force required for causing the initial breakage undesirably becomes off-centered.

If ho is more than 2.0 mm, when transporting the easy-open can lids stacked on each other, flaws are caused due to the upper and lower can lids rubbing against each other. Further, even if hi is more than 4.0 mm, there is the same type of problem in transport.

Using the panel portion of the can body as the horizontal standard, the height and length are calculated by the method shown in FIG. 7(A). The outer bead 13 may be a projection facing the can inside direction. Note that the height or depth of the outer bead 13 is preferably in the range of ($h_B$=) 0.2 to 3.0 mm. Of course, the above shape can be used for other types of easy-open can lids such as pull-tab types, full-open types, and pushdown types.

If $h_B$ is less than 0.2 mm, the rigidity of the can lid body side becomes smaller and there is an undesirable tendency for the pushdown force of the tab at the time of can opening not being effectively used. Further, if $h_B$ is more than 3.0 mm, when transporting the easy-open can lids stacked on each other, flaws are caused due to the upper and lower can lids rubbing against each other.

The steel plate, aluminum sheet, polyester resin, polyamide resin, resin coating, and method of processing used in the present invention are the same as the first aspect of the present invention explained above.

A third aspect of the present invention will be explained in detail below. First, the basic technical idea of the present invention will be explained.

Figure 9:
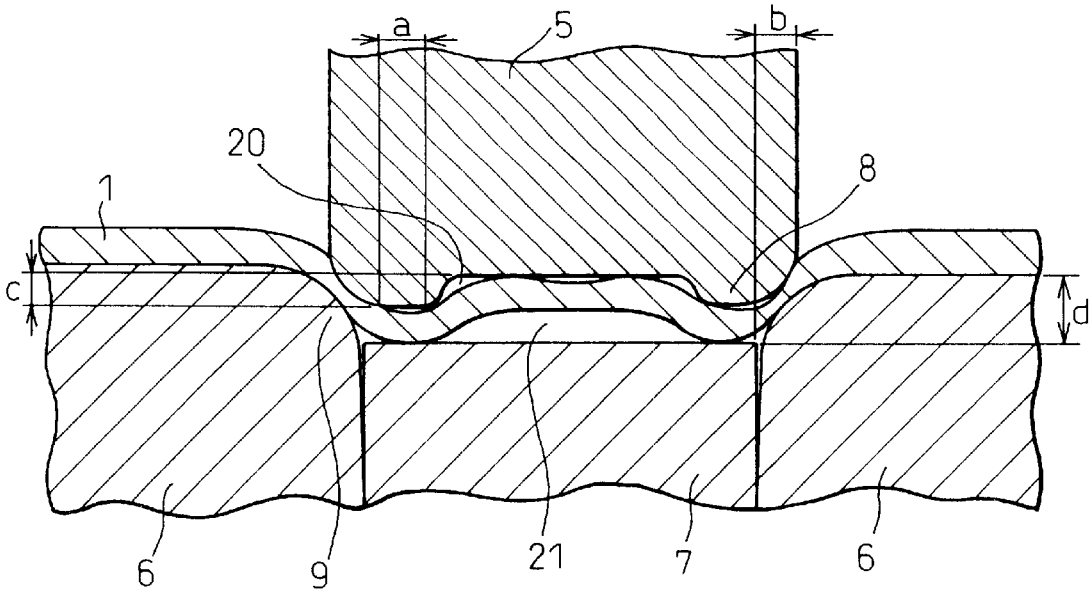
FIG. 9 is a view of the process of production of a can lid of a third aspect of the present invention.

The present inventors found that the inability to uniformly absorb the excess material caused at the material at the inside of the score line when pressed by die shoulders is one cause for the nonuniformity of the residual thickness. One reason for this is believed to be that the material at the inside of the score line at the time of pressing is not restrained by the die and free deformation is allowed. In the present invention, the left over material at the inside of the score line, as shown in FIG. 9, limits the space for the escape of the material by the space (recess) 20 formed in the die (punch) 5 at the inside of the score line or the space (recess) 20 formed in the dies (die) 6, 7 at the same side of the score line. Due to this, preferable control of the residual thickness over the entire length of the score line becomes possible. The important requirement of the present invention, as shown in FIG. 9, is that the width a of the flat portion from the punch shoulder to the punch head recess, the overlapping width b of the punch and die on the line parallel to the operation, the punch head recess c, and the die center recess depth d be suitably defined, whereby the shape of the escape portion of the material and the shape of the restraining portion of the material at the inside of the score line are suitably limited. Further, the radii of the die shoulders, clearance, residual thickness, etc. are the same as in the related art.

Below, a detailed explanation will be given of the reasons for the numerical limitations in the present invention.

When forming the shape of the opening portion by pressing by a die having part of an arc at the shoulder shape of the upper and lower dies, it is necessary that at least one of the punch shoulder R and the die shoulder R be not more than 2.0 mm. This is because when the shoulder R are too large, the score line becomes thicker and the concentration of stress on the score line disperses and the can openability is reduced. The lower limit is not particularly set, but 0.05 mm or more is preferable to maintain the soundness of the film.

Further, when forming the shape of the opening portion by pressing by upper and lower dies having part of an ellipse for the shape of the shoulders of the dies, it is necessary to make the long radius of the ellipse forming part of the shapes of the shoulders of the punch and die from 0.1 mm to 5.0 mm and the short radius from 0.05 mm to 4.0 mm.

If the long radius of the ellipse forming part of the shapes of the shoulders of the punch and die is more than 5.0 mm or the short radius is more than 4.0 mm, the score line becomes thick, the concentration of stress on the score line is dispersed, and the can openability is reduced.

Further, if the long radius of the ellipse forming part of the shape of the shoulders of the punch and die is less than 0.1 mm or the short radius is less than 0.05 mm, when using a metal sheet having a resin coating laminated on the can lid base material, it is not possible to maintain the soundness of the resin coating.

The punch head is formed with a recess for allowing the left over material to escape at the inside of the score line by pressing, but the depth is made 0.2 mm or more. Further, the depth of the recess at the center of the die is made not more than the (long radius of punch shoulder+long radius of die shoulder)×4. These values are important for controlling the escape of the material. In particular, the depth of the recess of the center of the die has to be controlled so that the bottom of the recess contacts the material at the time of processing. The limit of the depth depends on the amount of pressing, but it can be estimated as follows: That is, due to the reduction of the thickness at the time of pressing by the punch and die shoulders, the length of the score line becomes longer by about the extent of the (long radius of the punch shoulder+long radius of the die shoulder) in the vertical direction.

The outside of the score line is restrained by the beads etc., and therefore, it is believed that almost no movement of the material occurs. Therefore, material of about the (long radius of the punch shoulder+long radius of the die shoulder) occurs as excess material at the inside of the score line. The bulging of the material due to this probably becomes several times the (long radius of the punch shoulder+long radius of the die shoulder).

Regarding the determination of the various conditions, the effect of the ratio between the depth of the recess of the center of the die and the (long radius of the punch shoulder+long radius of the die shoulder) on the uniformity of the residual thickness was studied. As a result, it was found that if the depth of the recess of the center of the die becomes more than four times the (long radius of the punch shoulder+long radius of the die shoulder), the variation of the residual thickness becomes larger. That is, if over this extent of depth, the effect of the restraint of the material by the recess at the center of the die does not appear, that is, the bottom of the recess and the material no long contact each other. If there is no such contact, the escape of the material will not be controlled, the nonuniformity of the residual thickness will be greater like in the related art, and it will not be possible to satisfy the opening performance. Further, in the final stage of the pressing, the material guided into the punch recess contacts the bottom of the recess. When suitably pushed back, a pushback is given to the then thinnest score line and stress easily concentrates there at the time of opening operation, and therefore, the can openability is improved.

The width of the overlap of the punch and die on the line parallel to the operation of the punch is made less than the long radius of the punch shoulder+the long radius of the die shoulder. This is to form the sectional shape of the score line with a good can openability. If there is no overlapping width, shear deformation results, and therefore, it becomes difficult to form an extremely thin portion without breakage. Further, if the width becomes too great, the score line becomes thick, the concentration of stress on the score line is dispersed, and the can openability is reduced. While depending on the ductility of the material, it is preferable to make the overlapping width at least (long radius of punch shoulder+long radius of die shoulder)/2 to avoid the risk of breakage of the material due to shear deformation.

Further, in actual production, the width of the flat portion from the punch shoulder to the punch head recess changes over the entire length of the score line, but the maximum width is preferably made not more than 6.0 mm. This is to facilitate the escape of the excess material to the punch head recess. To restrain the escape of the excess material to the punch head recess to a certain extent, it is preferable to make the maximum width of the flat portion not less than 0.5 mm. Note that the material of the opening can lid using the present invention is not particularly limited. The effect can be obtained by an aluminum alloy sheet, steel sheet, or surface-treated sheets of the same or such sheets laminated with a resin film.

EXAMPLES

Examples of the present invention will be explained below together with the Comparative Examples.

Example I and Comparative Example I

Figure 10:
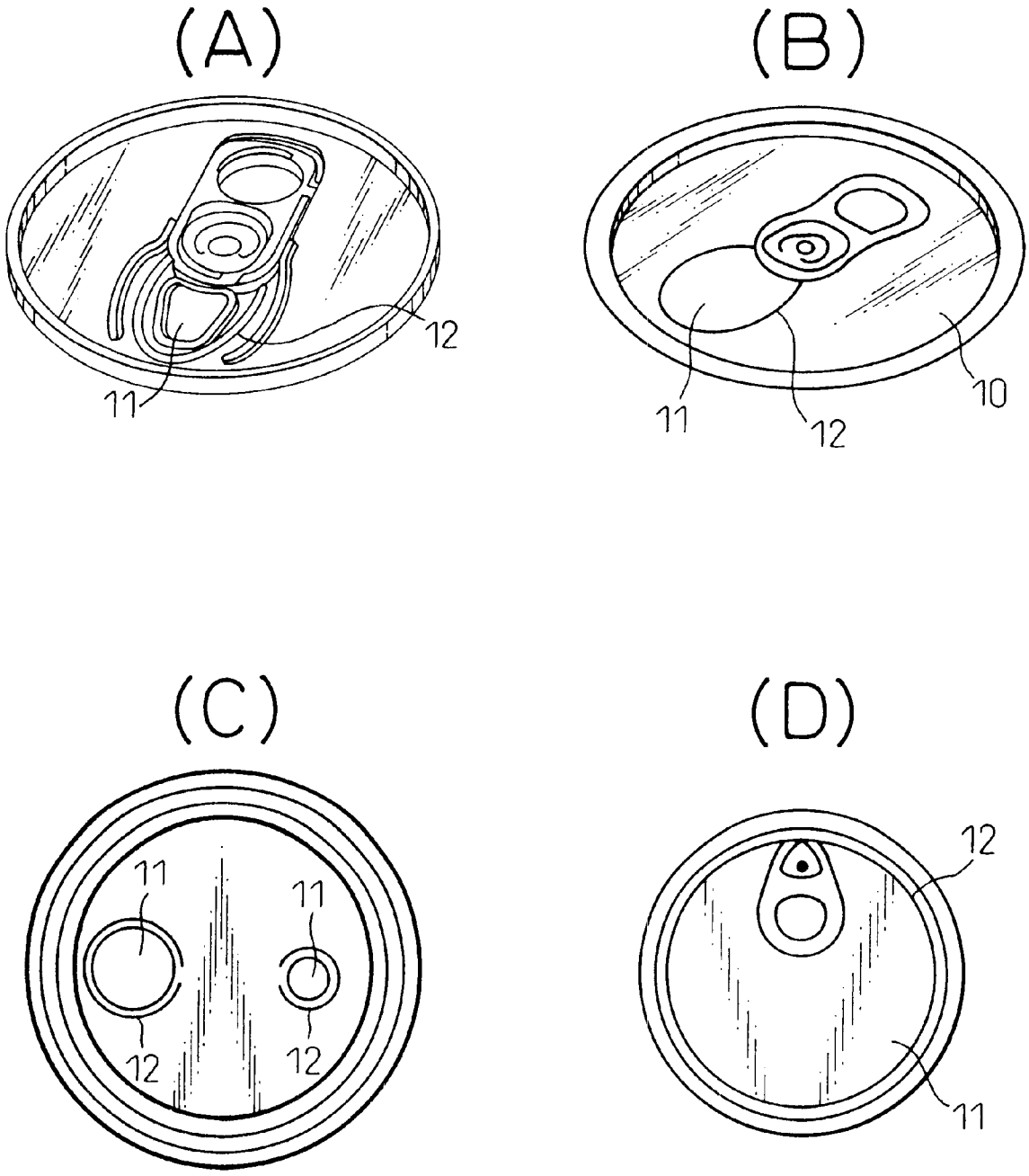
FIGS. 10(A), 10(B), 10(C), and 10(D) are views of typical easy-open can lids of the first aspect of the present invention.
Figure 11:
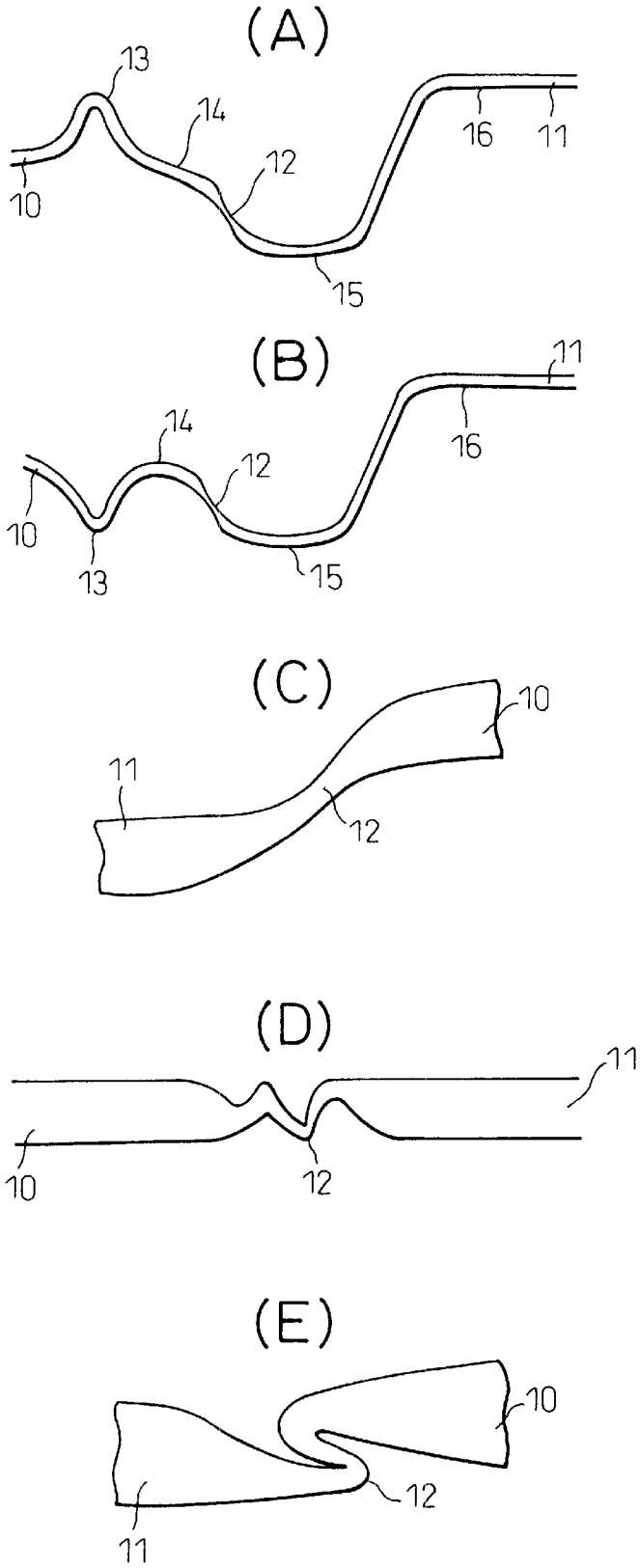
FIGS. 11(A), 11(B), 11(C), 11(D), and 11(E) are views of the sectional shapes of areas near the score line of the first aspect of the present invention.

The types (see FIG. 10), the sectional shape (see FIG. 11), and the materials of the easy-open can lids, the thicknesses, materials, resin coatings of the score line, and the results of the performance evaluation are shown in Table I-1.

FIG. 10(A) shows a stay-on tab type easy-open can lid, FIG. 10(B) shows a pull-tab type easy-open can lid, FIG. 10(C) shows a tabless type easy-open can lid, and FIG. 10(D) shows a full-open type easy-open can lid.

FIGS. 11(A) and 11(B) are sectional views of the areas near the score lines of the present invention, while FIGS. 11(C), 11(D), and 11(E) show sectional views of the areas near the score line of the Comparative Example.

For the evaluation, the corrosion resistance, can openability, and dropping strength were investigated.

The corrosion resistance was evaluated, as an evaluation of the can inner surface side, by filling the can with an aqueous solution of hydrochloric acid+iron chloride (75 cc of hydrochloric acid+150 g of $FeCl_2$+1925 cc of water), storing the can at 50° C. for one month, and examining it visually.

For the can outer surface side, the can was immersed in tap water at room temperature for one month and the state of occurrence of rust was visually examined.

Note that the can openability was judged by whether the can could be fully opened without problem and by measuring the opening strength. The dropping strength was evaluated by fabricating a can with an easy-open can lid filled with a liquid, dropping it vertically from a height of 60 cm five times, and examining the state of leakage of the contents from the easy-open can lid due to the dropping impact by n=50 times.

The evaluations of "extremely", "good", "practical", and "large variation" were made as in Table I-1.

With tab: FIG. 10(A): stay-on tab type easy-open can lid, FIG. 10(B): pull-tab type easy-open can lid, and FIG. 10(D): full-open type easy-open can lid.

Without tab: FIG. 10(C): tabless type easy-open can lid

TABLE I-1

| | Ex. I-1 | Ex. I-2 | Ex. I-3 | Ex. I-4 | Ex. I-5 | Ex. I-6 | Ex. I-7 | Ex. I-8 | Ex. I-9 |
|---|---|---|---|---|---|---|---|---|---|
| Can lid shape | | | | | | | | | |
| Type of easy-open can lid | FIG. 10C | FIG. 10A | FIG. 10A | FIG. 10A | FIG. 10B | FIG. 10D | FIG. 10C | FIG. 10A | FIG. 10A |
| Sectional shape | FIG. 11A | FIG. 11A | FIG. 11B | FIG. 11A | FIG. 11A | FIG. 11A | FIG. 11A | FIG. 11A | FIG. 11A |
| hi (mm) | 2.0 | 1.0 | 1.0 | 0.5 | 3.5 | 2.5 | 0.6 | 0.2 | 1.0 |
| wi (mm) | 2.0 | 0.3 | 1.5 | 0.2 | 2.0 | 3.5 | 0.2 | 2.0 | 1.5 |
| ho (mm) | 1.0 | 0.2 | 0.5 | 0.1 | 1.4 | 0.9 | 0.4 | 0.2 | 0.5 |
| wo (mm) | 2.0 | 0.3 | 0.5 | 0.5 | 2.5 | 1.5 | 0.3 | 2.0 | 0.5 |
| Thickness of metal sheet at score line (μm) | 30 | 45 | 65 | 100 | 120 | 150 | 7 | 15 | 25 |
| Rate of change of sheet thickness of score line portion (μm/mm) | 500 | 550 | 500 | 450 | 150 | 300 | 500 | 550 | 500 |
| Metal sheet | Al sheet | Al sheet | Al sheet | Al sheet | Al sheet | Al sheet | Steel sheet | Steel sheet | Steel sheet |

TABLE I-1-continued

| | | | | | | | | | |
|---|---|---|---|---|---|---|---|---|---|
| Sheet thickness (nm) | 0.23 | 0.25 | 0.25 | 0.25 | 0.25 | 0.23 | 0.19 | 0.19 | 0.19 |
| Type | 5082 series | 5017 series | 5052 series | 5182 series | 5352 series | 5349 series | TFS | CL | TFS |
| Weight (mg/m$^2$) | | | | | | | | | |
| Zirconium film[1)] | 10 | 10 | — | — | — | — | — | — | — |
| Hydrated Cr oxide[2)] | — | — | 50 | 40 | 45 | — | 17 | 25 | 17 |
| Metal Cr | — | — | — | — | — | — | 100 | 15 | 100 |
| Sn | — | — | — | — | — | — | — | 1050 | — |
| Ni | — | — | — | — | — | — | — | 20 | — |
| Resin film | | | | | | | | | |
| Inside surface | | | | | | | | | |
| Resin film | Poly-ester | Poly-ester | Poly-ester | Poly-ester | Poly-ester | Poly-ester | Poly-ester | Poly-ester | Poly-ester |
| Film thickness (μm) | 9 | 40 | 30 | 20 | 30 | 12 | 60 | 60 | 80 |
| Outside surface | | | | | | | | | |
| Resin film | Nylon 6 | Nylon 12 | Nylon 66 | Poly-ester | Nylon 6 | Nylon 6 | Nylon 6 | Nylon 6 | Nylon 6 |
| Film thickness (μm) | 9 | 40 | 30 | 20 | 30 | 12 | 60 | 60 | 80 |
| Performance evaluation | | | | | | | | | |
| Corrosion resistance | P | EG | EG | EG | G | C | P | G | EG |
| Can openability | EG | EG | EG | EG | G | P | EG | EG | EG |
| Initial opening force (kg) or full can openability | 3.5 | 1.5 | 1.8 | 2.1 | 2.3 | 3.0 | 3.6 | 1.6 | |
| Dropping strength | P | G | EG | EG | EG | EG | P | G | EG |
| No. of leaking cans/50 cans | 8 | 4 | 0 | 0 | 0 | 0 | 9 | 3 | 0 |

| | Ex. I-10 | Ex. I-11 | Ex. I-12 | Ex. I-13 | Ex. I-14 | Comp. Ex. I-1 | Comp. Ex. I-2 | Comp. Ex. I-3 | Comp. Ex. I-4 |
|---|---|---|---|---|---|---|---|---|---|
| Can lid shape | | | | | | | | | |
| Type of easy-open can lid | FIG. 10A | FIG. 10B | FIG. 10D | FIG. 10A | FIG. 10A | FIG. 10A SOT | FIG. 10A SOT | FIG. 10A SOT | FIG. 10A SOT |
| Sectional shape | FIG. 11A | FIG. 11A | FIG. 11A | FIG. 11A | FIG. 11A | FIG. 11C | FIG. 11D | FIG. 11E | FIG. 11A |
| hi (mm) | 0.5 | 3.5 | 0.6 | 5.0 | 2.0 | — | — | — | 2.0 |
| wi (mm) | 0.2 | 2.0 | 0.2 | 0.05 | 1.5 | — | — | — | 2.0 |
| ho (mm) | 0.1 | 1.4 | 0.4 | 2.5 | −0.3 | — | — | — | 1.0 |
| wo (mm) | 0.5 | 2.5 | 0.3 | 0.5 | 1.5 | — | — | — | 2.0 |
| Thickness of metal sheet at score line (μm) | 45 | 55 | 80 | 40 | 45 | 40 | 40 | 40 | 45 |
| Rate of change of sheet thickness of score line portion (μm/mm) | 450 | 950 | 700 | 500 | 450 | 500 | 500 | 500 | 1200 |
| Metal sheet | Steel sheet | Steel sheet | Steel sheet | Steel sheet | Steel sheet | Steel sheet | Steel sheet | Steel sheet | Steel sheet |
| Sheet thickness (mm) | 0.19 | 0.19 | 0.19 | 0.19 | 0.19 | 0.19 | 0.19 | 0.19 | 0.19 |
| Type | TFS | TFS | ET | TFS | TFS | TFS | TFS | TFS | TFS |
| Weight (mg/m$^2$) | | | | | | | | | |
| Zirconium film[1)] | — | — | — | — | — | — | — | — | — |
| Hydrated Cr oxide[2)] | 17 | 17 | 12 | 17 | 17 | 17 | 17 | 17 | 17 |
| Metal Cr | 100 | 100 | 12 | 100 | 100 | 100 | 100 | 100 | 100 |
| Sn | — | — | 2650 | — | — | — | — | — | — |
| Ni | — | — | — | — | — | — | — | — | — |
| Resin film | | | | | | | | | |
| Inside surface | | | | | | | | | |
| Resin film | Poly-ester | Poly-ester | Poly-ester | Poly-ester | Poly-ester | Poly-ester | Poly-ester | Poly-ester | Poly-ester |
| Film thickness (μm) | 30 | 12 | 9 | 30 | 30 | 30 | 30 | 30 | 30 |
| Outside surface | | | | | | | | | |
| Resin film | Nylon 6 | Nylon 6 | Nylon 6 | Nylon 6 | Nylon 6 | Nylon 6 | Nylon 6 | Nylon 6 | Nylon 6 |
| Film thickness (μm) | 30 | 12 | 9 | 30 | 30 | 30 | 30 | 30 | 30 |
| Performance evaluation | | | | | | | | | |
| Corrosion resistance | EG | P | P | P | P | EG | LV | LV | LV |
| Can openability | EG | G | P | EG | G | LV | EG | EG | EG |
| Initial opening force (kg) or full can openability | 2.1 | 2.5 | 3.0 | 2.0 | 2.5 | Can't open | 2.1 | 2.1 | 2.2 |

TABLE I-1-continued

| | | | | | | | | | |
|---|---|---|---|---|---|---|---|---|---|
| Dropping strengtn | EG | EG | EG | EG | EG | EG | EG | EG | EG |
| No. of leaking cans/50 cans | 0 | 0 | 0 | 0 | 0 | 0 | 0 | 0 | 0 |

TFS: Chrome-chromate treated steel sheet, ET: Electrical tin plated steel sheet, CL: Ni substrate thin Sn plated steel sheet
1)Shown as value converted to zirconium.
2)Amount of hydrated Cr oxide shows amount as Cr.
Evaluation of corrosion resistance: EG: Extremely good, C: Good, P: Practical, LV: Large variation (unstable)

TABLE I-2

| | Extremely good | Good | Practical | Large variation |
|---|---|---|---|---|
| Can openability (with tab) Initial force opening force | Under 2.2 kg, full opening | 2.3 to 2.7 kg, full opening | 2.8 to 3.2 kg, full opening | No full opening at over 3.3 kg |
| Possibility of full opening (without tab) Initial opening force | Under 3.7 kg | 3.8 to 4.2 kg | 4.3 to 4.7 kg | Over 4.8 kg |
| Dropping strength (number of leaking cans) | None | 1 to 4 | 5 to 9 | 10 or more |

Example II and Comparative Example II

Figure 12:
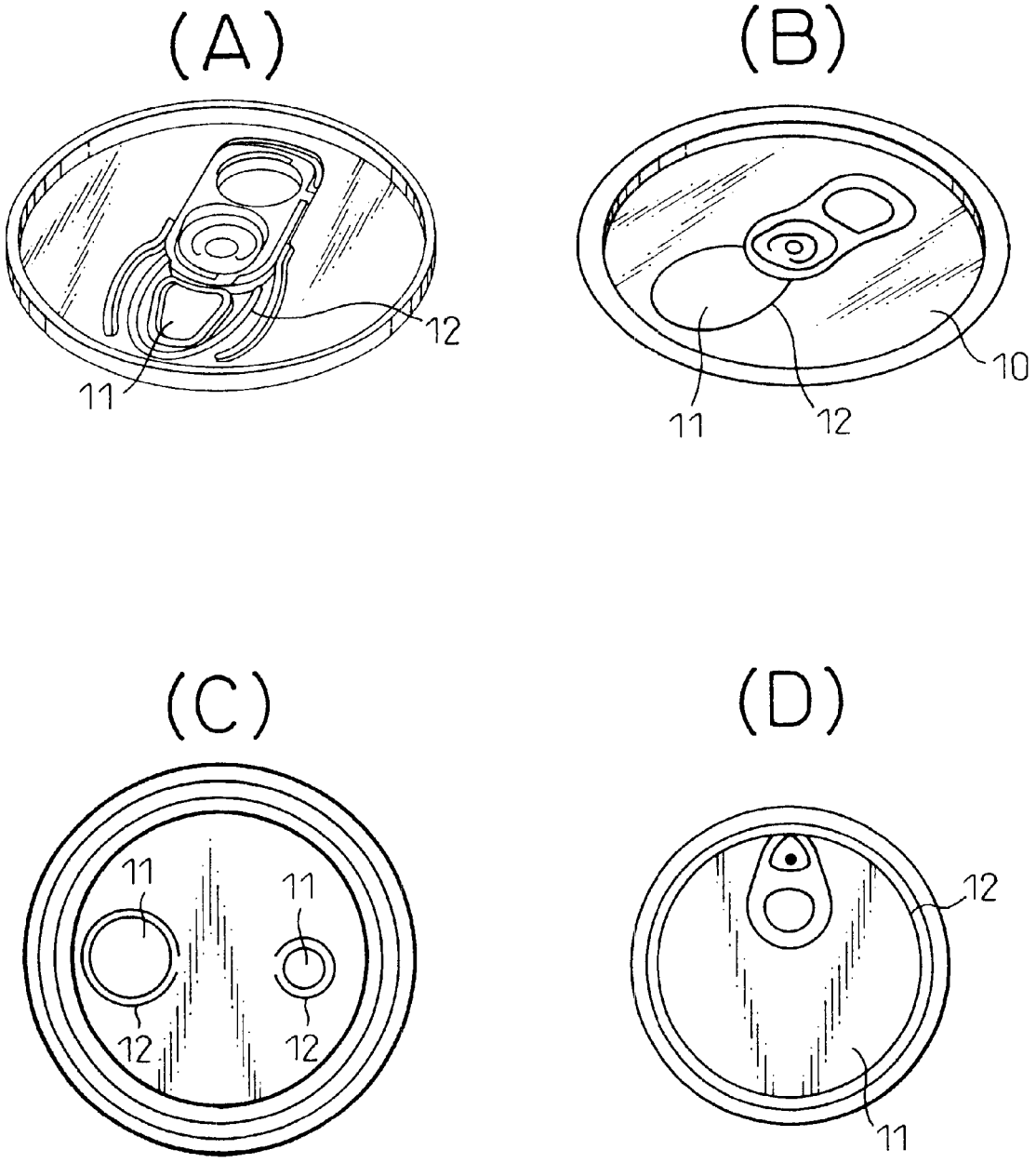
FIGS. 12(A), 12(B), 12(C), and 12(D) are views of typical easy-open can lids of the second aspect of the present invention.
Figure 13:
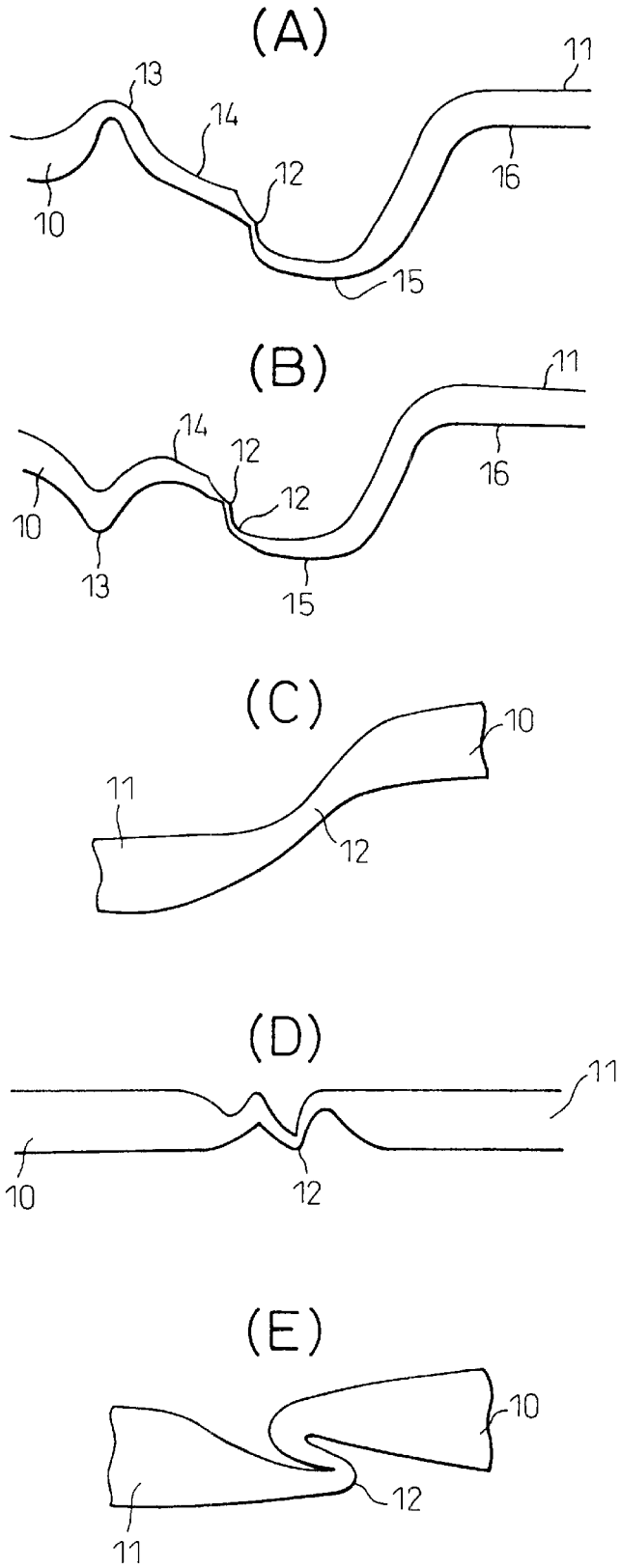
FIGS. 13(A), 13(B), 13(C), 13(D), and 13(E) are views of the sectional shapes of the areas near the score line of the second aspect of the present invention.

The types (see FIG. 12), the sectional shape (see FIG. 13), and the materials of the easy-open can lids, the thicknesses of the thinnest portions of the metal sheet, materials, resin coatings of the score line, and the results of the performance evaluation are shown in Table II-1.

FIG. 12(A) shows a stay-on tab type easy-open can lid, FIG. 12(B) shows a pull-tab type easy-open can lid, FIG. 12(C) shows a tabless type easy-open can lid, and FIG. 12(D) shows a full-open type easy-open can lid.

FIGS. 13(A) and 13(B) are sectional views of the areas near the score lines of the present invention, while FIGS. 13(C), 13(D), and 13(E) show sectional views of the areas near the score line of the Comparative Example.

For the evaluation, the corrosion resistance, can openability, and dropping strength were investigated.

The corrosion resistance was evaluated, as an evaluation of the can inner surface side, by filling the can with an aqueous solution of hydrochloric acid+iron chloride (75 cc of hydrochloric acid+150 g of $FeCl_2$+1925 cc of water), storing the can at 50° C. for one month, and examining it visually.

For the can outer surface side, the can was immersed in tap water at room temperature for one month and the state of occurrence of rust was visually examined.

TABLE II-1

| | Ex. II-1 | Ex. II-2 | Ex. II-3 | Ex. II-4 | Ex. II-5 | Ex. II-6 | Ex. II-7 | Ex. II-8 | Ex. II-9 |
|---|---|---|---|---|---|---|---|---|---|
| Can lid shape | | | | | | | | | |
| Type of easy-open can lid | FIG. 12A | FIG. 12C | FIG. 12A | FIG. 12A | FIG. 12B | FIG. 12D | FIG. 12A | FIG. 12C | FIG. 12C |
| Sectional ahape | FIG. 13A | FIG. 13A | FIG. 13B | FIG. 13A | FIG. 13A | FIG. 13A | FIG. 13A | FIG. 13A | FIG. 13B |
| hi (mm) | 2.0 | 3.7 | 0.3 | 0.5 | 3.5 | 0.1 | 2.0 | 3.7 | 4.5 |
| wi (mm) | 1.5 | 0.2 | 2.9 | 0.2 | 2.0 | 3.2 | 1.5 | 0.2 | 0.05 |
| ho (mm) | 1.0 | 1.8 | 0.05 | 0.2 | 1.4 | 2.2 | 1.0 | 1.9 | 2.5 |
| wo (mm) | 1.5 | 0.2 | 0.5 | 2.5 | 3.2 | 0.2 | 1.5 | 0.3 | 0.05 |
| Thickness of metal sheet at score line (μm) | 90 | 45 | 100 | 100 | 120 | 120 | 25 | 8 | 15 |
| Rate of change of sheet thickness of score line portion (μm/mm) | 500 | 725 | 500 | 200 | 950 | 300 | 500 | 260 | 300 |
| Angle (°) of bending of thinned portion | 45 | 25 | 15 | 175 | 50 | 45 | 85 | 105 | 25 |
| Metal sheet | Al sheet | Al sheet | Al sheet | Al sheet | Al sheet | Al sheet | Steel sheet | Steel sheet | Steel sheet |
| Sheet thickness (mm) | 0.23 | 0.25 | 0.25 | 0.25 | 0.25 | 0.23 | 0.19 | 0.19 | 0.19 |
| Type | 5052 series | 5017 aeriea | 5052 series | 5182 series | 5352 series | 5349 series | TFS | TFS | TFS |
| Weight (mg/m²) | | | | | | | | | |
| Zirconium film1) | 10 | 10 | — | — | — | — | — | — | — |
| Hydrated Cr oxide2) | — | — | 50 | 40 | 45 | — | 17 | 16 | 17 |

TABLE II-1-continued

| | | | | | | | | | |
|---|---|---|---|---|---|---|---|---|---|
| Metal Cr | — | — | — | — | — | — | 100 | 115 | 100 |
| Sn | — | — | — | — | — | — | — | — | — |
| Ni | — | — | — | — | — | — | — | — | — |
| Resin film | | | | | | | | | |
| Inside surface | | | | | | | | | |
| Resin film | Poly-ester | Poly-ester | Poly-ester | Poly-ester | Poly-ester | Poly-ester | Poly-ester | Poly-eater | Poly-ester |
| Film thickness (μm) | 25 | 55 | 30 | 20 | 30 | 12 | 40 | 95 | 60 |
| Outside surface | | | | | | | | | |
| Resin film | Nylon 6 | Nylon 12 | Nylon 66 | Poly-ester | Nylon 6 | Nylon 6 | Nylon 6 | Nylon 6 | Nylon 6 |
| Film thickness (μm) | 25 | 55 | 30 | 20 | 30 | 12 | 40 | 95 | 60 |
| Performance evaluation | | | | | | | | | |
| Corrosion resistance | EG | EG | EG | P | G | G | EG | G | EG |
| Can openability | EG | EG | G | EG | G | G | EG | EG | G |
| Initial opening force (kg) or full can openability | 1.5 | 3.5 | 2.3 | 2.1 | 2.3 | 2.7 | 1.8 | 3.6 | 4.0 |
| Dropping strength | EG | EG | EG | EG | EG | EG | EG | P | G |
| No. of leaking cans/50 cans | 0 | 0 | 0 | 0 | 0 | 0 | 0 | 5 | 1 |

| | Ex.II-10 | Ex. II-11 | Ex.II-12 | Ex. II-13 | Ex. II-14 | Comp. Ex. II-1 | Comp. Ex. II-2 | Comp. Ex. II-3 | Comp. Ex. II-4 |
|---|---|---|---|---|---|---|---|---|---|
| Can lid shape | | | | | | | | | |
| Type of easy-open can lid | FIG. 12A | FIG. 12B | FIG. 12D | FIG. 12A | FIG. 12A | FIG. 12A SOT | FIG. 12A SOT | FIG. 12A SOT | FIG. 12A SOT |
| Sectional shape | FIG. 13A | FIG. 13A | FIG. 13A | FIG. 13A | FIG. 13A | FIG. 13C | FIG. 13D | FIG. 13E | FIG. 13A |
| hi Cmm) | 0.5 | 0.2 | 0.6 | 5.0 | 2.0 | — | — | — | 2.0 |
| wi (mm) | 0.2 | 3.1 | 0.2 | 0.05 | 1.5 | — | — | — | 2.0 |
| ho (mm) | 0.2 | 1.4 | 0.4 | 2.5 | −0.3 | — | — | — | 1.o |
| wo (mm) | 0.5 | 3.3 | 0.3 | 0.2 | 2.5 | — | — | — | 2.0 |
| Thickness of metal sheet at score line (μm) | 45 | 55 | 80 | 40 | 45 | 40 | 45 | 45 | 45 |
| Rate of change of sheet thickness of score line portion (μm/mm) | 450 | 950 | 700 | 500 | 450 | 500 | 450 | 450 | 1200 |
| Angle (°) of bending of thinned portion | 15 | 40 | 45 | 60 | 120 | — | — | — | — |
| Metal sheet | Steel sheet | Steel sheet | Steel sheet | Steel sheet | Steel sheet | Steel sheet | Steel sheet | Steel sheet | Steel sheet |
| Sheet thickness (mm) | 0.19 | 0.19 | 0.19 | 0.19 | 0.19 | 0.19 | 0.19 | 0.19 | 0.19 |
| Type | CL | TFS | ET | TFS | TFS | TFS | TFS | TFS | TFS |
| Weight (mg/m$^2$) | | | | | | | | | |
| Zirconium film[1)] | — | — | — | — | — | — | — | — | — |
| Hydrated Cr oxide[2)] | 10 | 17 | 12 | 17 | 17 | 17 | 17 | 17 | 17 |
| Metal Cr | 14 | 100 | 12 | 100 | 100 | 100 | 100 | 100 | 100 |
| Sn | 1050 | — | 2650 | — | — | — | — | — | — |
| Ni | 20 | — | — | — | — | — | — | — | — |
| Resin film | | | | | | | | | |
| Inside surface | | | | | | | | | |
| Resin film | Poly-ester | Poly-ester | Poly-ester | Poly-ester | Poly-ester | Poly-ester | Poly-ester | Poly-ester | Poly-ester |
| Film thickness (μm) | 30 | 12 | 9 | 30 | 30 | 30 | 30 | 30 | 30 |
| Outside surface | | | | | | | | | |
| Resin film | Nylon 6 | Nylon 6 | Nylon 6 | Nylon 6 | Nylon 6 | Nylon 6 | Nylon 6 | Nylon 6 | Nylon 6 |
| Film thickness (μm) | 30 | 12 | 9 | 30 | 30 | 30 | 30 | 30 | 30 |
| Performance evaluation | | | | | | | | | |
| Corrosion resistance | EG | P | P | EG | G | EG | P | P | LV |
| Can openability | G | G | P | G | G | LV | P | P | EG |
| Initial opening force (kg) or full can openability | 2.6 | 2.5 | 3.0 | 2.4 | 2.5 | Can't open | 2.8 | 2.8 | 2.2 |
| Dropping strength | EG | EG | EG | EG | EG | EG | EG | EG | EG |
| No. of leaking cans/50 cans | 0 | 0 | 0 | 0 | 0 | 0 | 0 | 0 | 0 |

TFS: Chrome-chrosate treated steel sheet, ET: Electrical tin plated steel sheet, CL: Ni substrate thin Sn plated steel sheet

[1)]Shown as value converted to zirconium.

[2)]Amount of hydrated Cr oxide shows amount as Cr.

Evaluation of corrosion resistance: EG: Extremely good, G: Good, P: practical, LV: Large variation (unstable)

Note that the can openability was judged by whether the can could be fully opened without problem and by measuring the opening strength. The dropping strength was evaluated by fabricating a can with an easy-open can lid filled with a liquid, dropping it vertically from a height of 60 cm five times, and examining the state of leakage of the content from the easy-open can lid due to the dropping impact by n=50 times.

TABLE III-1

| Punch shoulder R (mm) | Die shoulder R (mm) | Punch head recess depth (mm) | Die recession depth (mm) | Upper and lower die overlap (mm) | Variation in residual thickness after processing (μm) | Can openability | Film soundness | Dropping strength | Evaluation |
|---|---|---|---|---|---|---|---|---|---|
| 0.5 | 0.5 | 0.5 | 3.0 | −0.5 | 15 | — | LV | LV | Comp. Ex. |
| 0.5 | 0.5 | 0 | 10* | 0.5 | 55 | G | G | LV | Comp. Ex. |
| 0.5 | 0.5 | 0.5 | 10* | 0.5 | 20 | G | G | G | Ex. |
| 0.5 | 0.5 | 0 | 0.5 | 0.5 | 20 | G | G | G | Ex. |
| 0.5 | 0.5 | 0.5 | 1.0 | 0.5 | 10 | G | G | G | Ex. |
| 0.5 | 0.5 | 0.5 | 3.0 | 0.5 | 15 | G | G | G | Ex. |
| 0.5 | 0.5 | 0.5 | 5.0 | 2.0 | 25 | LV | G | G | Comp. Ex. |
| 3.0 | 0.5 | 0.5 | 5.0 | 0.5 | 20 | G | G | G | Ex. |
| 3.0 | 3.0 | 0.5 | 5.0 | 0.5 | 15 | LV | G | G | Comp. Ex. |

The "*" in the "Die recess depth" column shows that the material does not contact the bottom of the recess at the center of the die at the inside of the score line.
The negative value at the "Upper and lower die overlap" column shows that the punch does not overlap the die on the line of operation.
The "—" in the "Can openability" column shows that there is already breakage at part of the score line before the opening operation.

The evaluations of "extremely", "good", "practical", and "large variation" were made as in Table II-2.

With tab: FIG. 12(A): stay-on tab type easy-open can lid, FIG. 12(B): pull-tab type easy-open can lid, and FIG. 12(D): full-open type easy-open can lid.

Without tab: FIG. 12(C): tabless type easy-open can lid

TABLE II-2

| | Extremely good | Good | Practical | Large variation |
|---|---|---|---|---|
| Can openability (with tab) Initial opening force Possibility of full opening | Under 2.2 kg, full opening | 2.3 to 2.7 kg, full opening | 2.8 to 3.2 kg, full opening | No full opening at over 3.3 kg |
| (without tab) Initial opening force | Under 3.7 kg | 3.8 to 4.2 kg | 4.3 to 4.7 kg | Over 4.8 kg |
| Dropping strength (number of leaking cans) | None | 1 to 4 | 5 to 9 | 10 or more |

Example III and Comparative Example III

The material of the easy-open can lid used was a laminated steel sheet comprised of surface-treated steel sheet laminated with a resin film. The surface-treated steel sheet was pressed as explained above to prepare an easy-open can lid. The shape of the die used when the target residual thickness is 40 μm, the shape of the easy-open can lid prepared, and the results of evaluation are shown in Table III-1.

Figure 14:
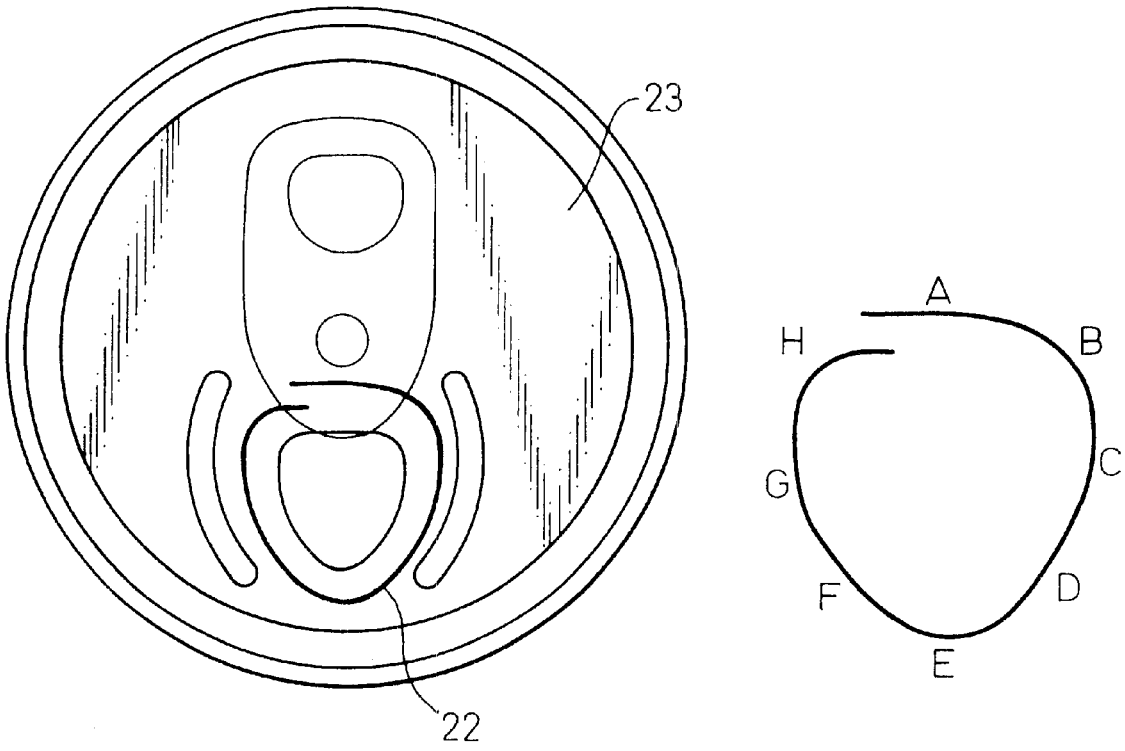
FIG. 14 is a view of the outside surface of a typical easy-open can lid produced by the third aspect of the present invention.

The variation in the residual thickness was found by measuring the thicknesses of the thinnest portion from examination of the cross-section of the thickness for eight points, that is, A, B, C, D, E, F, G, and H along the score line 22 shown in FIG. 14 and finding the difference between the maximum value and the minimum value of the thickness. For the evaluation of the characteristics of the can lid 23, the soundness of the coating, the can openability, and the dropping strength were investigated.

Note that the soundness of the coating was evaluated by a conduction test. The can openability was evaluated by whether full opening was possible without problem and by measuring the opening force. The dropping strength was evaluated by preparing a can with an easy-open can lid filled with a liquid, dropping it vertically from a height of 60 cm five times, and investigating the state of the leakage of the contents from the easy-open can lid due to the dropping impact.

Figure 15:
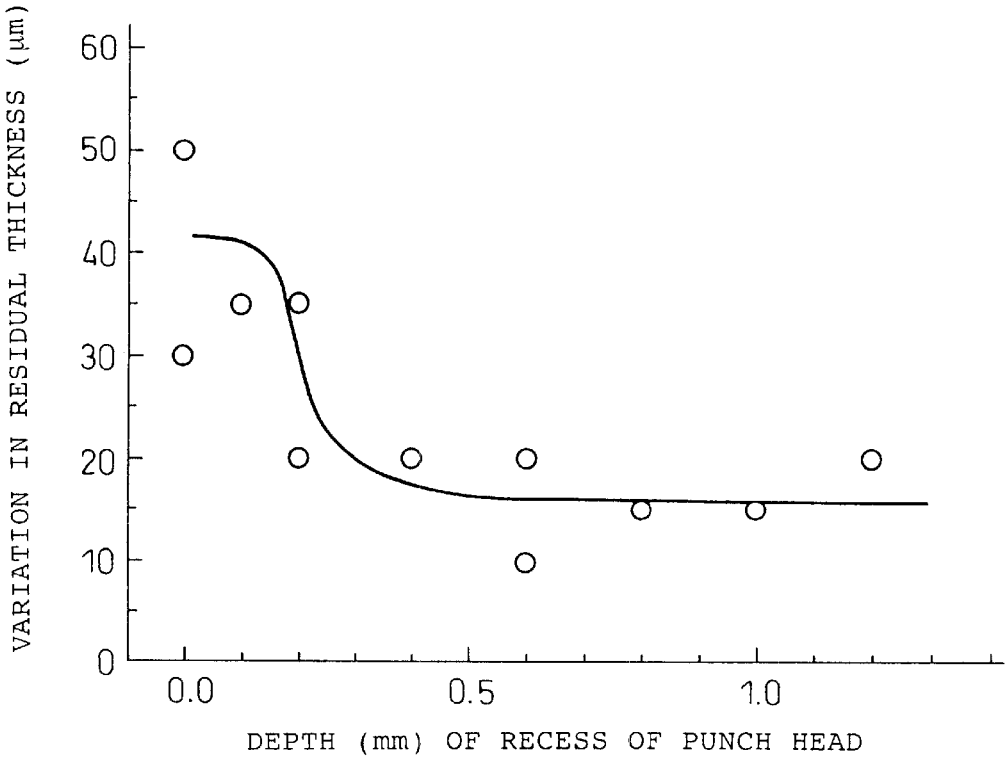
FIG. 15 is a view of the effects of the depth of the recess of the punch head on the variations in the residual thickness in the embodiments.
Figure 16:
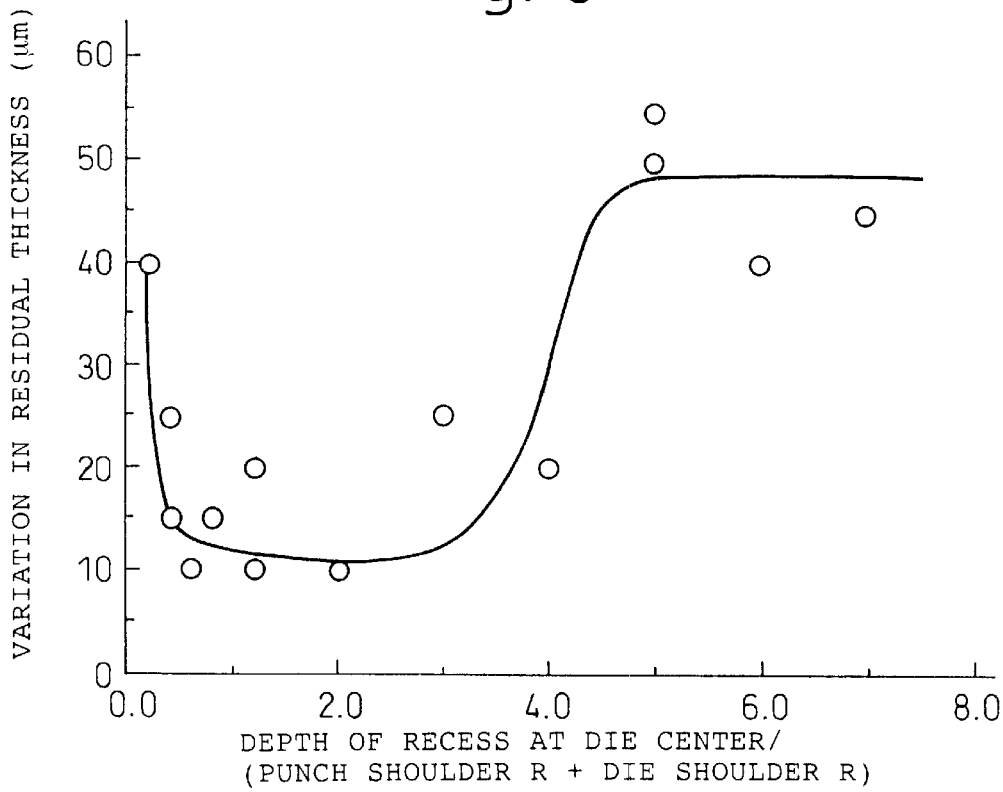
FIG. 16 is a view of the effects of the depth of the recess of the die center on the variations in the residual thickness in the embodiments.

Further, the results of study of the variations in the residual thickness under various conditions were analyzed by the punch head recess depth and/or die center recess depth/(punch shoulder R+die shoulder R) in FIG. 15 and FIG. 16. From these results as well, the concepts behind the numerical limitations of the recess depth were verified.

Easy-open can lids were prepared by pressing a laminated steel sheet comprised of a surface-treated steel sheet on which a resin film is laminated in the same way as in the Examples and Comparative Examples shown in Table III-1. The shape of the die used when the target residual thickness is 40 μm, the shape of the easy-open can lid prepared, and the results of evaluation are shown in Table III-2.

TABLE III-2

| Punch shoulder | | Die shoulder | | Upper and lower die | Punch head recess | Die recess | Variation in residual thickness after | | | | |
|---|---|---|---|---|---|---|---|---|---|---|---|
| Ra (mm) | Rb (mm) | Ra (mm) | Rb (mm) | overlap (mm) | depth (mm) | depth (mm) | processing (μm) | Can openability | Film soundness | Dropping strength | Remarks |
| 1.0 | 0.5 | 1.0 | 0.5 | 0.5 | 0.5 | 0.5 | 10 | G | G | G | Ex. |
| 1.0 | 0.5 | 1.0 | 0.5 | 0.5 | 0.5 | 5.0 | 15 | G | G | G | Ex. |
| 3.0 | 1.5 | 0.2 | 0.1 | 0.2 | 0.5 | 0.5 | 20 | G | G | G | Ex. |
| 1.0 | 0.5 | 1.0 | 0.5 | 0.6 | 0.3 | 0.5 | 20 | G | G | G | Ex. |
| 1.0 | 0.5 | 1.0 | 0.5 | 0.5 | 0 | 0.5 | 15 | G | G | G | Ex. |
| 1.0 | 0.5 | 1.0 | 0.5 | 0.5 | 0.5 | 10* | 15 | G | G | G | Ex. |
| 1.0 | 0.5 | 1.0 | 0.5 | −0.5 | 0.5 | 0.5 | 15 | — | G | G | Comp. Ex. |
| 1.0 | 0.5 | 1.0 | 0.5 | 0.5 | 0 | 10* | 50 | G | G | LV | Comp. Ex. |
| 6.0 | 3.0 | 6.0 | 3.0 | 0.5 | 0.5 | 0.5 | 25 | LV | LV | G | Comp. Ex. |
| 5.0 | 4.5 | 5.0 | 4.5 | 0.5 | 0.5 | 0.5 | 25 | LV | LV | G | Comp. Ex. |

The "*" in the "Die recess depth" column shows that the material does not contact the bottom of the recess at the center of the die at the inside of the score line.
The negative value at the "Upper and lower die overlap" column shows that the punch does not overlap the die on the line of operation.
The "—" in the "Can openability" column shows that there is already breakage at part of the score line before the opening operation.
Ra: long diameter
Rb: short diameter From the above results, it was learned that the can lids produced in the scope of the present invention had a small variation in residual thickness and were excellent in characteristics as can lids.

INDUSTRIAL APPLICABILITY

As explained above, the easy-open can lid of the present invention uses a material obtained by laminating a resin film on a metal sheet, provides a score line by pressing without using a sharp blade, and makes the shape near it a specific shape, whereby achievement of the goal of the related art, that is, realization of both can openability and corrosion resistance, becomes possible. Further, if a steel easy-open can lid can be commercialized, conversion to "monometal cans" would become possible, whereby products suited for recycling to deal with the recent problems of the global economy can be supplied to the market. Of course, steel sheet itself is superior in economy. By making both the can body and the can lid by steel sheet, it is possible to expect products which are superior in economy and can easily be reutilized as resources.

Further, the method of forming the easy-open can lid of the present invention forms a score line by pressing while avoiding the problem of tool life, a major problem of the related art, and enables the production, with a good productivity, of can lids with an extremely small variation in thickness over the entire length of the score line and satisfying the properties of the can lid.

LIST OF REFERENCES

1 . . . Can lid material
2 . . . Die
3 . . . Die
4 . . . Score line (score)
5 . . . Punch
6 . . . Die
7 . . . Die
8 . . . Punch shoulder
9 . . . Die shoulder
10 . . . Can lid body
11 . . . Tear strip
12 . . . Score line (bent portion)
13 . . . Outer bead
14 . . . Outer peripheral flat portion
15 . . . Inner peripheral flat portion
16 . . . Inner bead
17 . . . Bent portion of thin portion
18 . . . Center line
19 . . . Angle of bend
20 . . . Space
21 . . . Space
22 . . . Score line
23 . . . Can lid
a . . . Width of flat portion from bench shoulder to recess of punch head
b . . . Overlapping width of punch and die on parallel line of operation
c . . . Depth of recess of punch head
d . . . Depth of recess of die center

What is claimed is:

1. A metal easy-open can lid superior in can openability having a resin coating on at least one surface thereof;

said easy-open can lid having an outer peripheral flat portion, an inner peripheral flat portion, a score line portion located between said outer peripheral flat portion and said inner peripheral flat portion, with a score line located in said score line portion;

an outer bead located at a side of said outer peripheral flat portion which is opposite to said score line;

an inner bead located at a side of said inner peripheral flat portion which is opposite to said score line;

said score line portion having a cross-sectional thickness which gradually becomes thinner at a rate of change of cross-sectional thickness of not more than 1000 μm/mm from a location adjacent said outer peripheral flat portion to a location at said score line and said score line portion having a cross-sectional thickness which gradually becomes thinner at a rate of change of cross-sectional thickness of not more than 1000 μm/mm from a location adjacent said inner peripheral flat portion to a location at said score line.

2. A metal easy-open can lid according to claim 1, wherein said can lid has a can outer surface side and a can inner surface side;

at least the inner bead has a shape projecting toward the can outer surface side;

a deepest recess point projecting toward the can inner surface side of the inner peripheral flat portion is located at a range of 0.2 to 4.0 mm from a highest projecting point of the inner bead toward the can outer surface side;

the outer peripheral flat portion adjacent the score line portion is located in a range of 0.1 to 2.0 mm toward the can outer surface side from a deepest recess point toward the can inner surface side of the inner peripheral flat portion;

the inner peripheral flat portion has a cross-section with a thickness of from 0.1 to 3.0 mm; and the outer peripheral flat portion has a cross-section with a thickness of from 0.1 to 3.0 mm.

3. An easy-open can lid according to claim 1, wherein the an lid is formed from a metal sheet and said metal sheet is selected from the group consisting of a steel sheet, a surface-treated steel sheet, an aluminum sheet, and an aluminum alloy sheet.

4. An easy-open can lid according to claim 1, wherein the can lid is formed from a metal sheet and the can lid has a can inner surface side;

wherein the resin coating on at least the can inner surface side of the metal sheet is a thermoplastic saturated polyester-based resin having a thickness of 10–100 μm.

5. An easy-open can lid according to claim 1, wherein the can lid is formed from a metal sheet and the can lid has an outer surface side;

wherein the resin coating on the can lid outer surface side is a polyamide resin having a thickness of 10–100 μm.

6. An easy-open can lid according to claim 1, wherein the can lid is opened by a method selected from:

opening using a tab separating part or all of the can lid from a can body;

opening using a tab leaving part or all of the can lid on the can body.

7. An easy-open can lid according to claim 1, wherein the can lid is selected from a type comprising:

a tabless can lid having a tear strip provided at least at one location on the can lid for separating part or all of the can lid from a can body;

a tabless can lid having a tear strip provided at least at one location on the can lid for leaving part or all of the can lid on the can body.

8. A metal easy-open can lid according to claim 1, wherein said score line portion having said gradually thinner cross-sectional thickness is bent.

9. A metal easy-open can lid according to claim 8, wherein said can lid has a can outer surface side and a can inner surface side;

at least the inner bead has a shape projecting toward the can outer surface side;

a deepest recess point projecting toward the can inner surface side of the inner peripheral flat portion is located at a range of 0.2 to 4.0 mm from a highest projecting point of the inner bead toward the can outer surface side;

the outer peripheral flat portion adjacent the score line portion is located in a range of 0.1 to 2.0 mm toward the can outer surface side from a deepest recess point toward the can inner surface side of the inner peripheral flat portion;

the inner peripheral flat portion has a cross-section with a thickness of from 0.1 to 3.0 mm; and the outer peripheral flat portion ha s a cross-section with a thickness of from 0.1 to 3.0 mm.

10. A method of forming an easy-open can lid superior in can openability comprising:

providing an upper punch having a shoulder and a lower die having a shoulder;

providing a recess at a center location of the upper punch and providing a recess at center location of the lower die, said recesses provided for restraining a material to be shaped;

pressing the material to be shaped with the shoulder of the upper punch and the shoulder of the lower die;

providing at least one upper punch shoulder R and at least one lower die shoulder R, with R of not more than 2.0 mm;

overlapping the upper punch and the lower die on a line parallel to operation of the upper punch.

11. A method of forming an easy-open can lid according to claim 10 further comprising:

providing the recess at the center location of the lower die with a depth of not more than (upper punch shoulder R+lower die shoulder R)×4.

12. A method of forming an easy-open can lid according to claim 10 further comprising:

providing the recess at the center location of the upper punch with a depth of at least 0.2 mm.

13. A method of forming an easy-open can lid superior in can openability comprising:

providing an upper punch having a shoulder and a lower die having a shoulder;

providing a recess at a center location of the upper punch and providing a recess at a center location of the lower die, said recesses provided for restraining a material to be shaped;

pressing the material to be shaped with the shoulder of the upper punch and the shoulder of the lower die;

providing the shoulder of the upper punch and the shoulder of the lower die with a shape of part of an ellipse having a long radius of 0.1 to 5.0 mm and a short radius of 0.05 to 4.0 mm;

overlapping the upper punch and the lower die on a line parallel to operation of the upper punch.

14. A method of forming an easy-open can lid according to claim 13 further comprising:

providing the recess at the center location of the lower die with a depth of not more than (long radius of upper punch shoulder+long radius of lower die shoulder)×4.

* * * * *